US008125385B2

(12) United States Patent
Singleton et al.

(10) Patent No.: US 8,125,385 B2
(45) Date of Patent: Feb. 28, 2012

(54) APPARATUS AND METHOD FOR PHASE FRONTS BASED ON SUPERLUMINAL POLARIZATION CURRENT

(75) Inventors: John Singleton, Los Alamos, NM (US); Houshang Ardavan, Cambridge (GB); Arzhang Ardavan, Cambridge (GB)

(73) Assignee: Los Alamos National Security, LLC, Los Alamos, NM (US)

( * ) Notice: Subject to any disclaimer, the term of this patent is extended or adjusted under 35 U.S.C. 154(b) by 204 days.

(21) Appl. No.: 12/191,148

(22) Filed: Aug. 13, 2008

(65) Prior Publication Data

US 2010/0039324 A1 Feb. 18, 2010

(51) Int. Cl.
*H01Q 3/02* (2006.01)

(52) U.S. Cl. ..... 342/374

(58) Field of Classification Search ..... 342/81, 342/157, 372, 374, 375

See application file for complete search history.

(56) References Cited

U.S. PATENT DOCUMENTS 4,893,071 A * 1/1990 Miller ..... 324/660

* cited by examiner

*Primary Examiner* — Dao Phan

(74) *Attorney, Agent, or Firm* — Husch Blackwell LLP

(57) ABSTRACT

An apparatus and method for a radiation source involving phase fronts emanating from an accelerated, oscillating polarization current whose distribution pattern moves superluminally (that is, faster than light in vacuo). Theoretical predictions and experimental measurements using an existing prototype superluminal source show that the phase fronts from such a source can be made to be very complex. Consequently, it will be very difficult for an aircraft imaged by such a radiation to detect where this radiation has come from. Moreover, the complexity of the phase fronts makes it almost impossible for electronics on an aircraft to synthesize a rogue reflection. A simple directional antenna and timing system should, on the other hand, be sufficient for the radar operators to locate the aircraft, given knowledge of their own source's speed and modulation pattern.

20 Claims, 22 Drawing Sheets

202
204

208
204
206

202
210
215
205
0 0 0 + + + + 0 0 0

212
214
215
210
0 0 0 0 + + + + 0 0

205
212
214
205

210

Fig. 3(a)
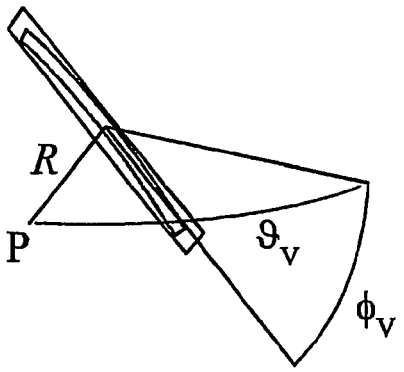
Fig. 3(b)
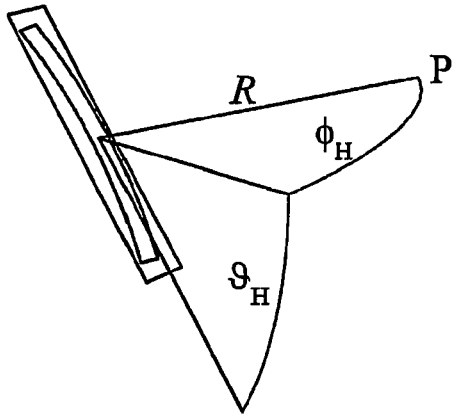
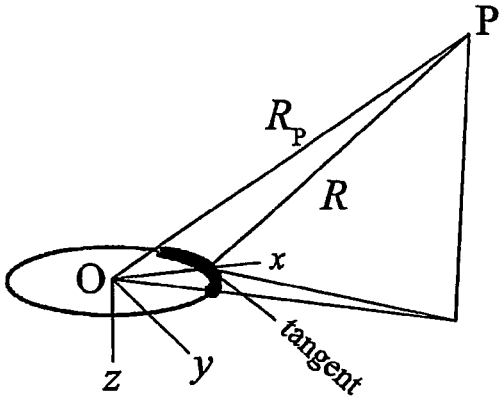
Fig. 3(c)
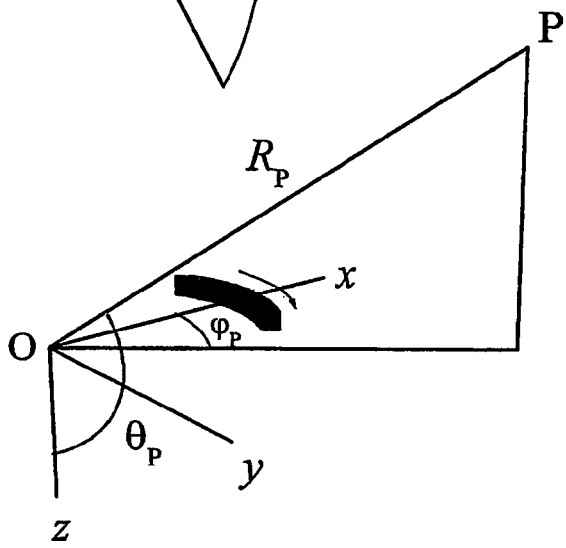
Fig. 3(d)

APPARATUS AND METHOD FOR PHASE FRONTS BASED ON SUPERLUMINAL POLARIZATION CURRENT

1. STATEMENT REGARDING FEDERAL RIGHTS

This invention was made with partial government support under Contract No. DE-AC52-06NA25396 awarded by the U.S. Department of Energy. The government has certain rights in the invention.

2. BACKGROUND OF INVENTION

This invention relates generally to radiation emitting sources for sensing targets and, more particularly, to radiation emitting sources, for example radar systems, which emit radiation and sensing reflections for target detection.

In the past, there have been known methods employed for locating radar emitter sources, which required the knowledge of several parameters related to the operation of the emitter source measurements made from two or more known spatial locations, and/or the known rate of relative motion of the emitter source. Conventional radar sources can be vulnerable to countermeasures because the emitted radiation possesses rather simple phase fronts. The countermeasures that can be employed by an aircraft that is being imaged include sending a missile down a course perpendicular to the phase fronts to destroy the radar installation, or sending back "rogue" radiation with an altered phase front pattern to suggest a reflection from elsewhere. Each of these methods require an assessment of the phase front emitted by the source, which is easier to perform if the phase front lacks complexity.

The principles of phase-front analysis may be understood by considering a very simple phased array consisting of three dipole antennae at positions whose cylindrical polar coordinates (r, $\phi$, z) have the values (0, 0, 0), (a,+$\pi$/2, 0) and (a,−$\pi$/2, 0)

If the dipole antennae are excited in phase at an angular frequency $\omega$, it is simple to show that the signal received at time $t_P$ at a far-field observation point P with the spherical coordinates ($R_P$>>a, $\theta_P=\pi/2$, $\phi_P$) will have the amplitude $$E \propto \frac{1}{R_P}\cos\left[\omega\left(t_P - \frac{R_P}{c}\right)\right]\left[1 + 2\cos\left(\frac{\omega a \sin\varphi_P}{c}\right)\right], \tag{1}$$

where c is the speed of light in vacuo, and the origin of the time coordinate is chosen to remove any arbitrary phase. Note that the time-independent part of this expression has zero crossings at $$\varphi_P = \arcsin\left[\frac{2\pi c}{\omega a}\left(j \pm \frac{1}{3}\right)\right], \tag{2}$$

where j is an integer (see FIG. 1 for a plot of $E^2$).

Now consider two closely-spaced detectors, labelled P and Q and placed at positions ($R_P$, $\pi/2$, $\phi_P+\delta\phi_P$) and ($R_Q$, $\pi/2$, $\phi_P-\delta\phi_P$). The signals $V_P$ and $V_Q$ detected by P and Q will be of the following form $$V_P=A_P\cos(\omega t_P-\gamma_P) \text{ and } V_Q=A_Q\cos(\omega t_P-\gamma_Q), \tag{3}$$

where $\gamma_P$ and $\gamma_Q$ are phases that depend on the relative positions of P and Q. If the detectors are identical in all respects, and $R_P=R_Q$, then $\gamma_P-\gamma_Q$ vanishes for all $\phi_P$, apart from a very small region of angular width $2\delta\phi_P$ around each of the zero-crossings defined by Eq. 2, where $|\gamma_P-\gamma_Q|=\pi$ (see FIG. 1). Away from the angles at which zero crossings occur, setting $R_P\neq R_Q$ introduces a phase difference $\gamma_P-\gamma_Q=(\omega/c)(R_P-R_Q)$.

The surface defined by $R_P=R_Q$ therefore represents a surface of constant phase, or "phase front".

The detection of such phase fronts, by appropriate positioning of P and Q, constitutes a method for locating the direction of the phased array. Although modifications can be made to the relative phases of the elements of a phased array to "steer" the beam or apply an apparent slant to the phase front, the very regular nature of the phase fronts that emanate from such systems makes them vulnerable to being located and subjected to countermeasures.

An essential part of warfare involving radiation sensing systems is the location of targets or reference marks by means of a detection system such as radar, and it is common that any potential enemy will take steps, such as the creation of interference utilizing countermeasure devices to prevent the effective use of detection equipment against targets. Such countermeasure devices can assume various forms such as for example an inverse gain repeater, a range gate pull-off repeater, chaff, radar decoys, image frequency jammers, and other forms. A usual target that utilizes such countermeasure technology is an aircraft.

In a known method, knowledge of the waveform modulation of the emitter source in the time or frequency domain can be utilized. An example of such a requirement included the scan rate, the pulse duration, the pulse interval and/or the frequency modulation patterns. In another known method, measurements can be provided in the form of the emitter signal angle of arrival or the emitter signal time of arrival. Measurements in the form of angle of arrival can be utilized in the process of triangulation. The emitter signal measurements of angle and time of arrival can then be employed in conjunction with the time and location of the measurements to ascertain emitter location. Yet another known method utilized for determining the range to a radar emitter involved the measurement of angular rates between the emitter source and the measurements site/platform.

In the field of microwave radar, a technique has long been used in which an interrogating radar signal is deceived by returning a distorted signal having a discontinuity or other alteration in the phase front, so that it appears to be coming from a different point in space. The art has long sought an equivalent for laser radar. The detection of the location of a radar source by way of analysis of a phase front and the ability to alter the phase front so that it appears that the target is at a different point, is made possible due to the non-complex nature of a conventional phase front. A more complex phase front is needed to avoid some of these countermeasure techniques.

3. BRIEF SUMMARY OF INVENTION

The invention is a radiation source involving phase fronts emanating from an accelerated, oscillating, superluminal (that is, faster than light in vacuo) polarization current. The present invention using a superluminal source shows that the phase fronts from such a source can be made to be very complex. Consequently, it can be very difficult for an aircraft imaged by such radiation to detect where this radiation comes from. Moreover, the complexity of the phase fronts makes it almost impossible for electronics on an aircraft to synthesize a rogue reflection. A simple directional antenna and timing system should, on the other hand, be sufficient for the radar operators to locate the aircraft, given knowledge of their own source's speed and modulation pattern.

The superluminal source has another advantage; the radiation from the source may be steered electronically (that is, without moving the antenna) by changing the speed at which the distribution pattern of the polarization current propagates, which can be controlled by the voltage switching function of the elements. Indeed, the linearity of the emission process makes it possible for a superluminal source to emit tightly-beamed radiation of several different frequencies in several directions simultaneously.

Radar detection of aircraft (and indeed ships and other vehicles) is used by virtually all branches of the armed forces. The invention can limit the vulnerability of current radar systems.

The present invention involves a technique for generating phase fronts of considerable complexity using a polarization current with a superluminally moving distribution pattern that both oscillates and possesses centripetal acceleration. The test data indicates that the phase difference between signals detected by closely-spaced antennae assumes a wide range of values and is a rapidly varying function of both the absolute and relative positions of the detectors. The underlying reason for this complexity is that the reception time is a multi-valued function of the retarded time in the case of emission from superluminal sources. The distinctive traits of the phase fronts emanating from a superluminal source suggest that such a source could be employed in a radar system that would be much more robust against countermeasures.

These and other advantageous features of the present invention will be in part apparent and in part pointed out herein below.

4. BRIEF DESCRIPTION OF THE DRAWINGS

For a better understanding of the present invention, reference may be made to the accompanying drawings in which:

FIG. 2(*b*) illustrates how applying a spatially varying electric field induces a polarization, where the distribution pattern of the electric field is moving causing the polarized region to move;

FIG. 2(*c*) is a schematic side view of a practical superluminal emitter;

FIG. 2(*d*) illustrates movement of the polarization region by varying the voltages of the electrodes;

FIG. 2(*e*) is a schematic top view of a practical superluminal emitter showing the curvature of the dielectric;

FIG. 2(*f*) is a view of the practical superliminal emitter illustrating the amplifiers that provide the voltage for the electrodes;

FIG. 2(*g*) illustrates the means by which the practical superliminal emitter is rotated;

Figure 4A:
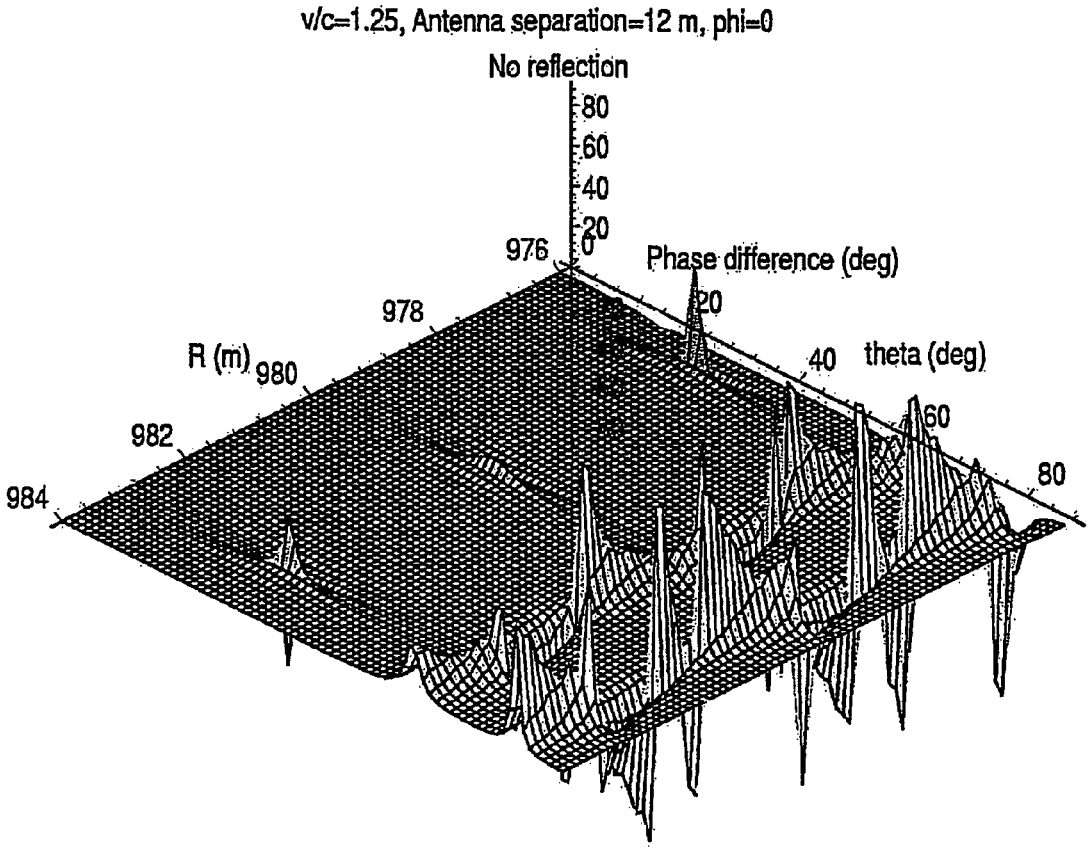
Figure 4B:
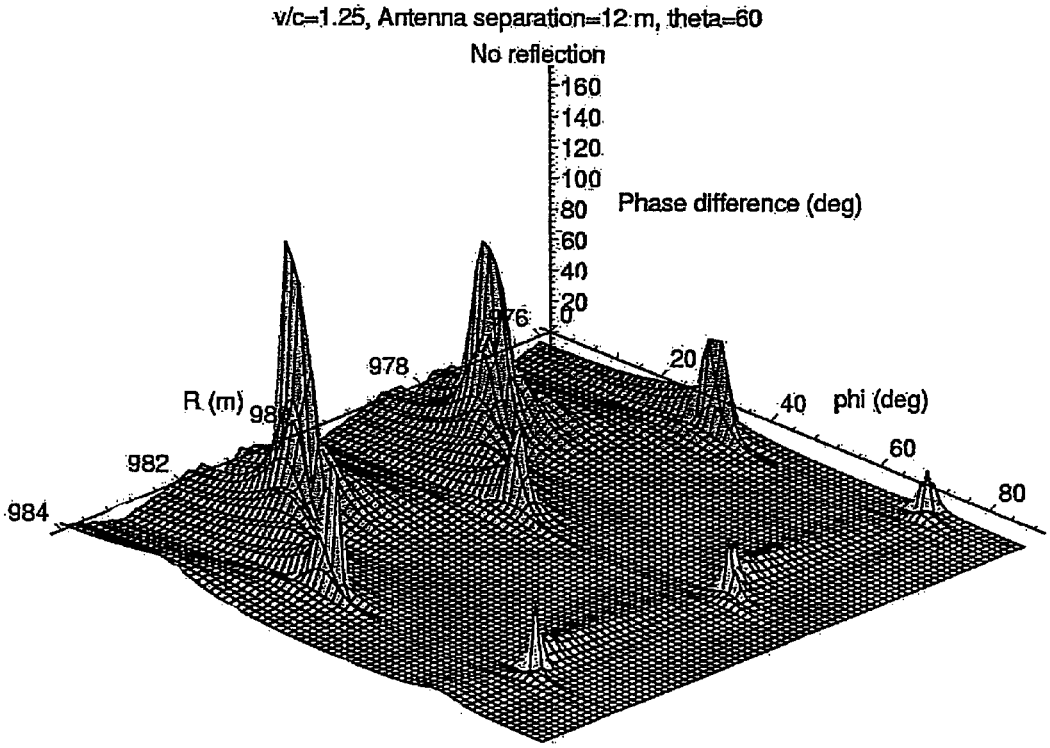
Figure 5A:
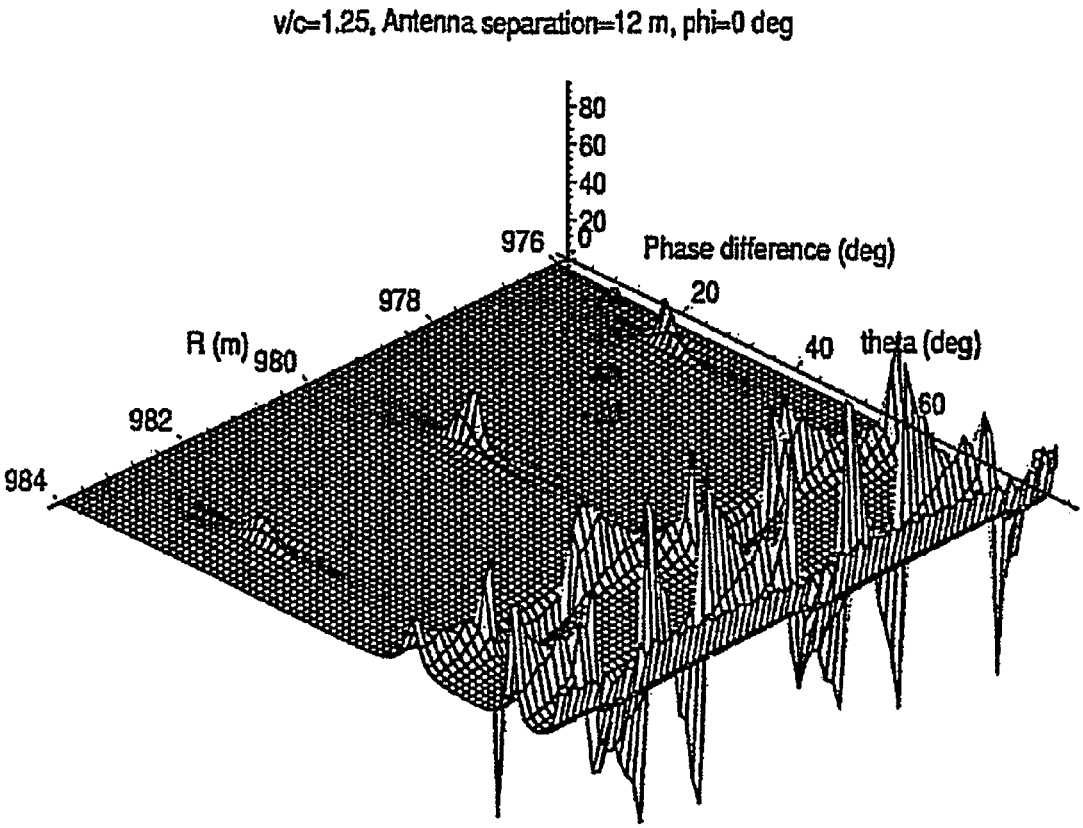
Figure 5B:
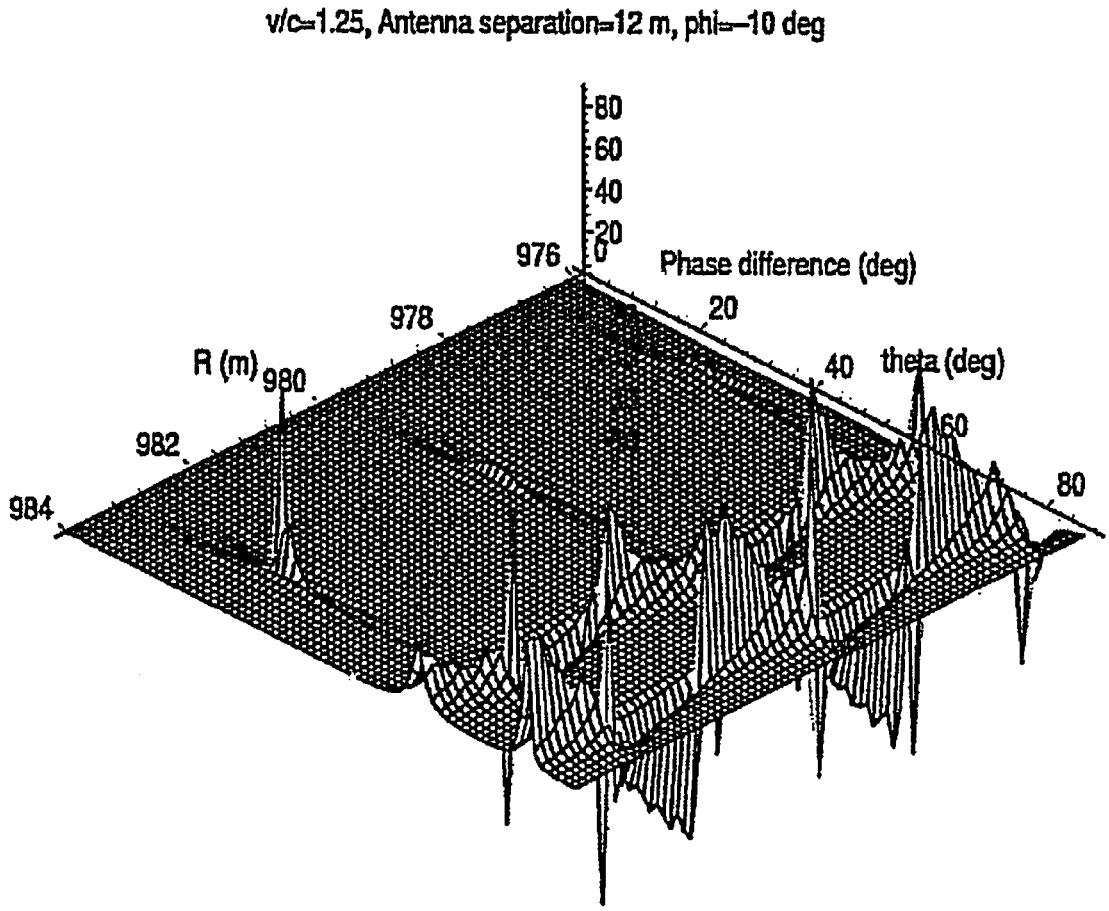
Figure 5C:
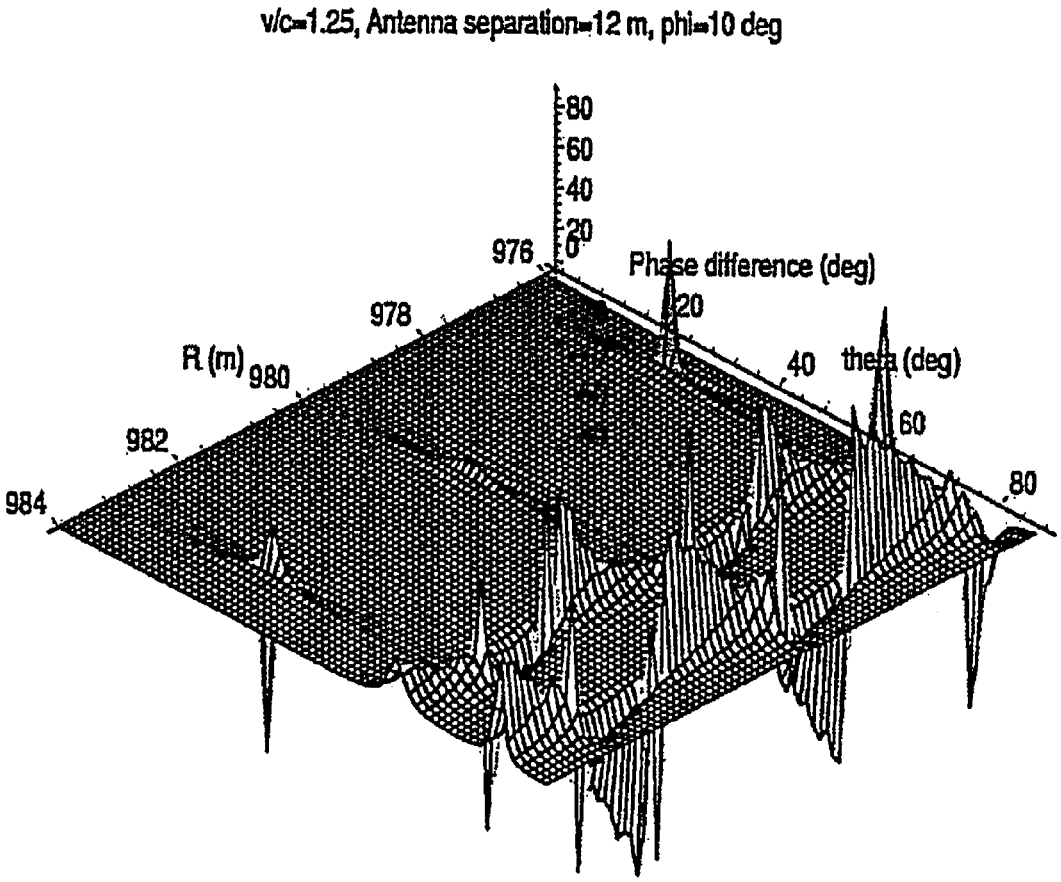
Figure 6A:
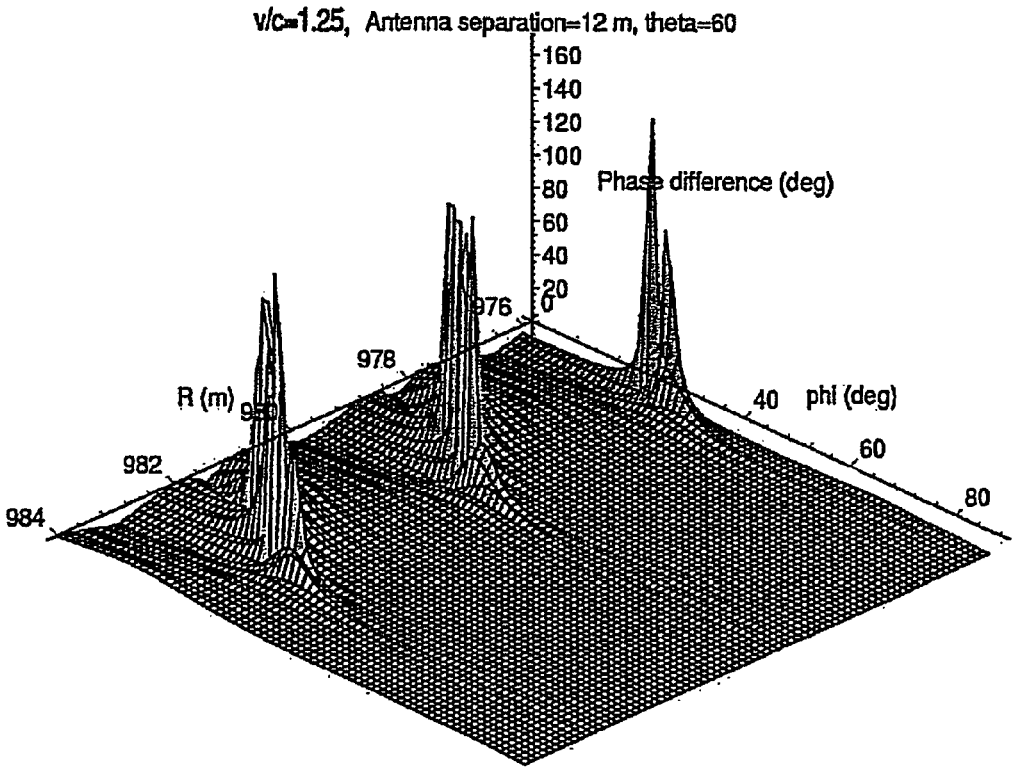
Figure 6B:
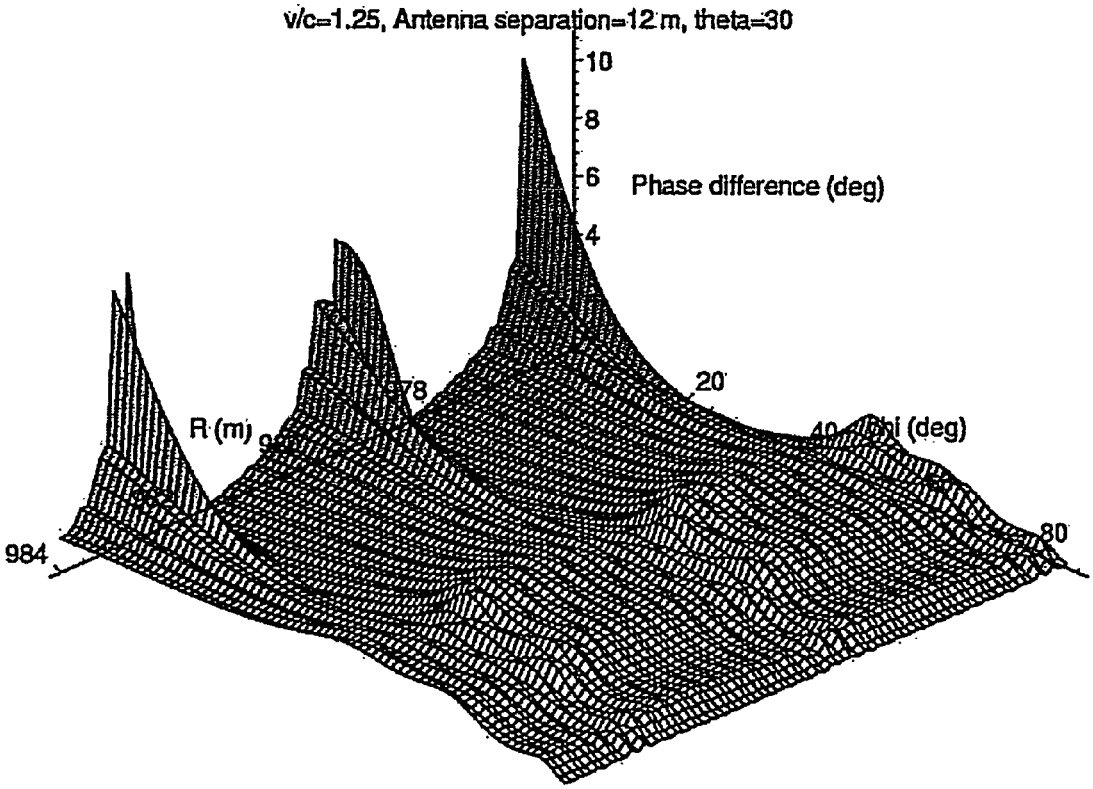
Figure 7A:
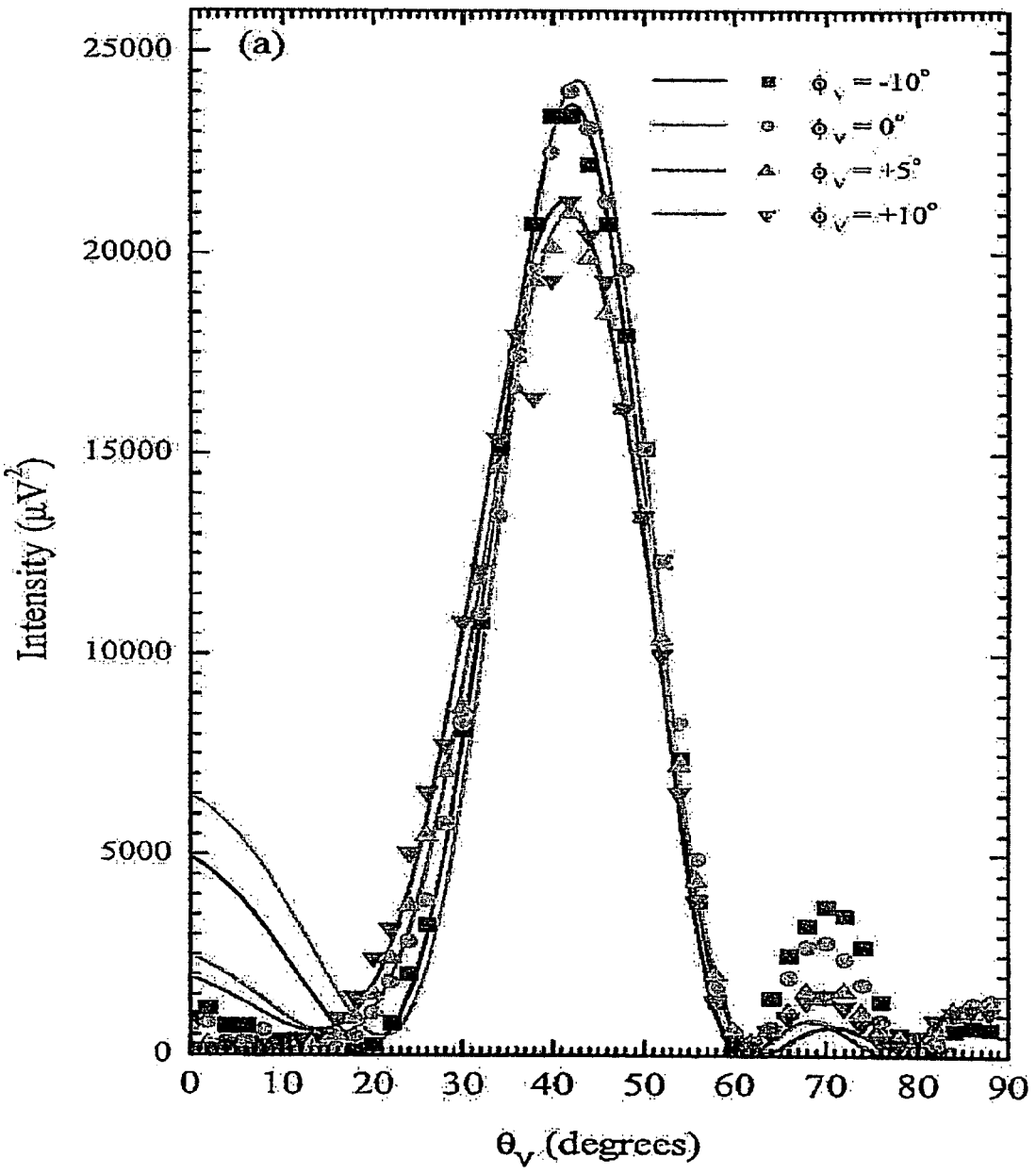
Figure 7B:
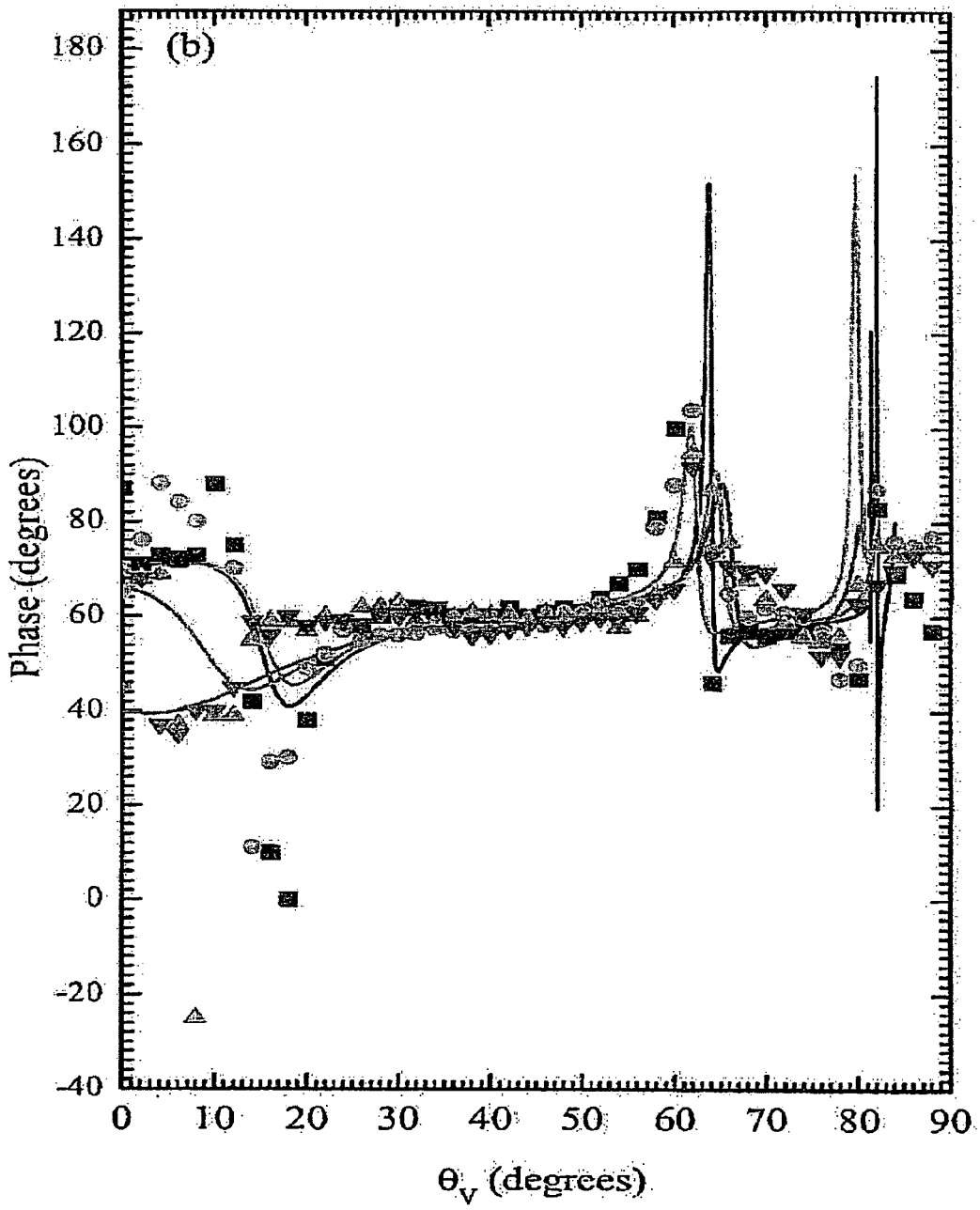
Figure 8A:
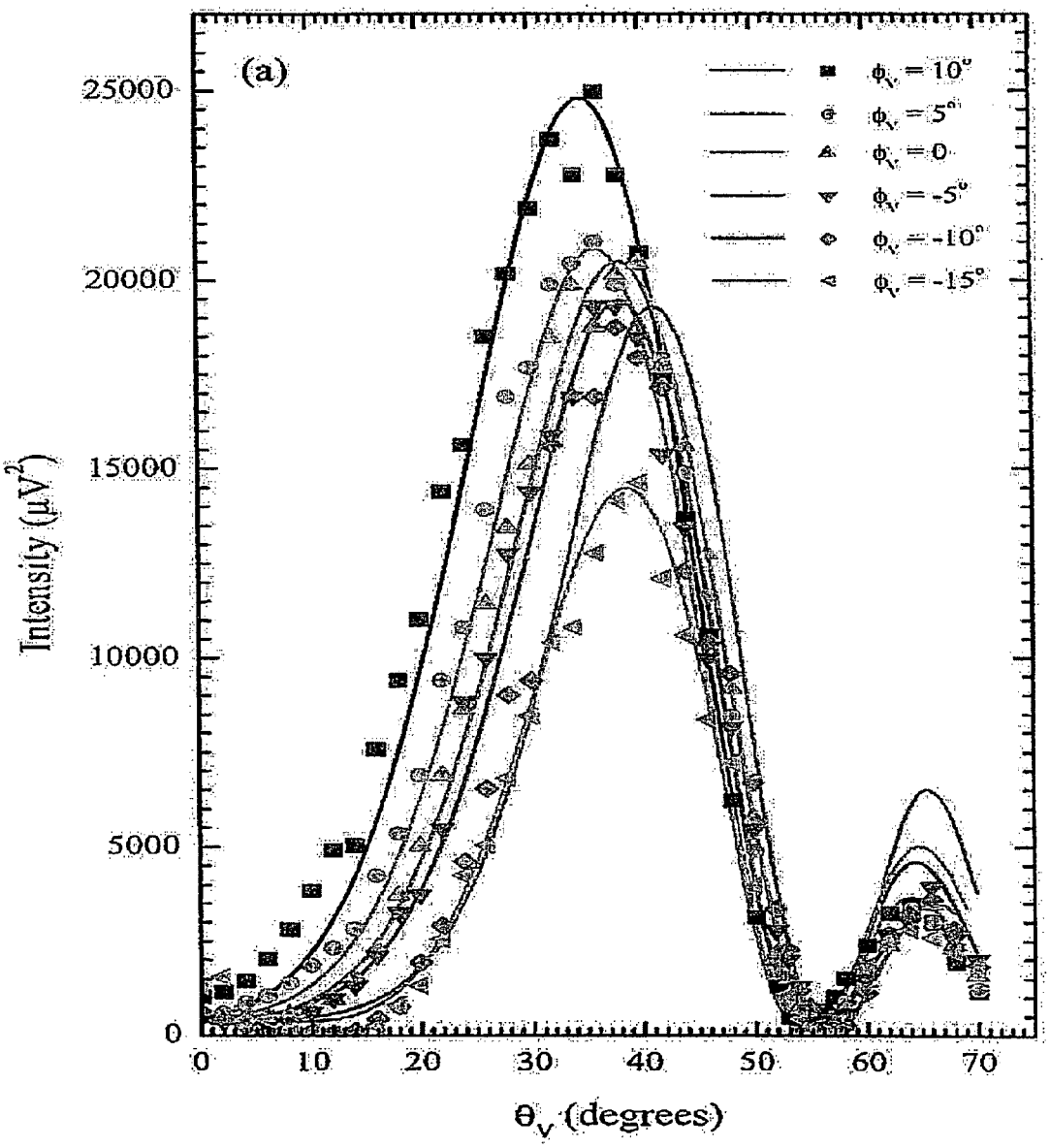
Figure 8B:
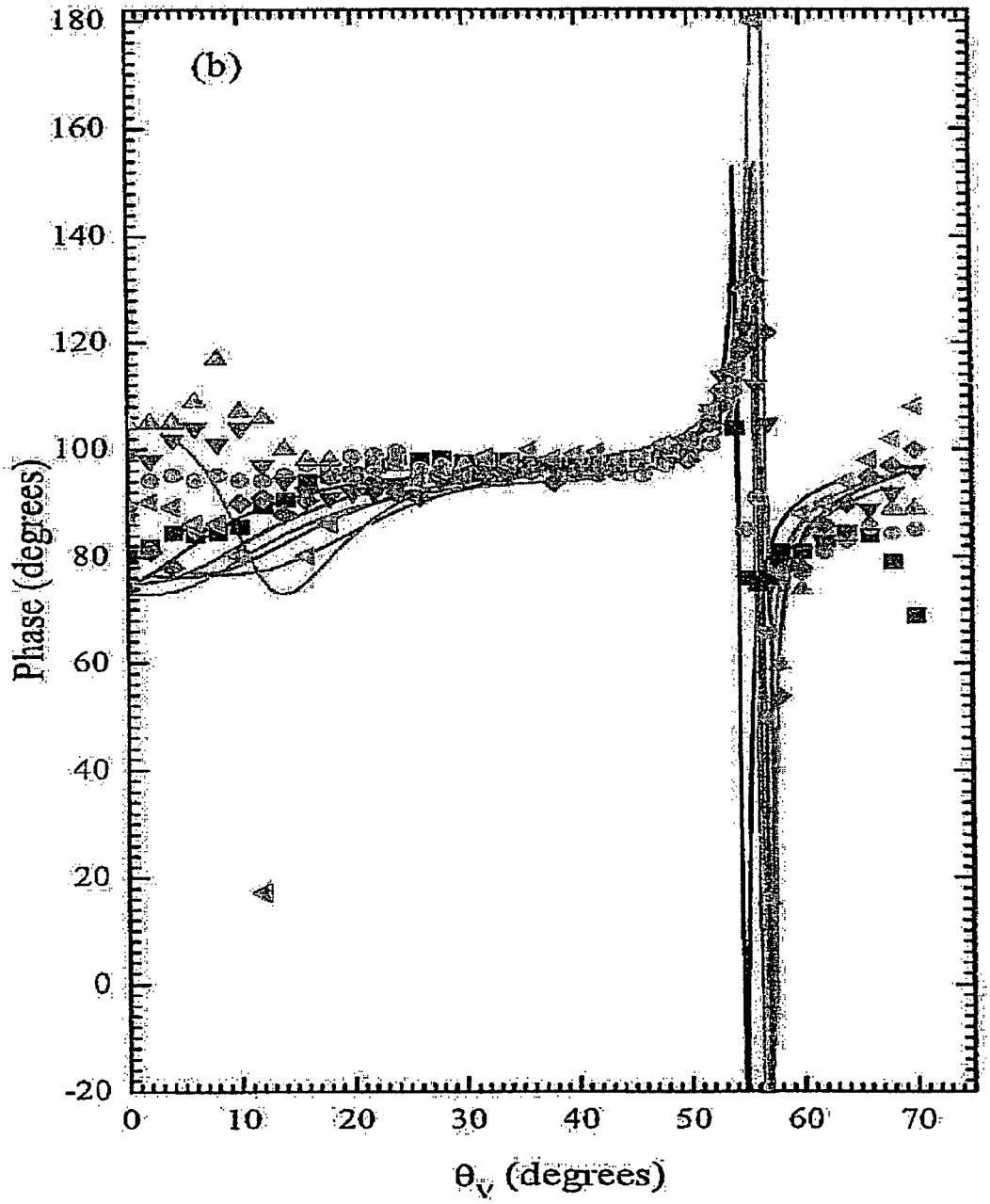
Figure 9A:
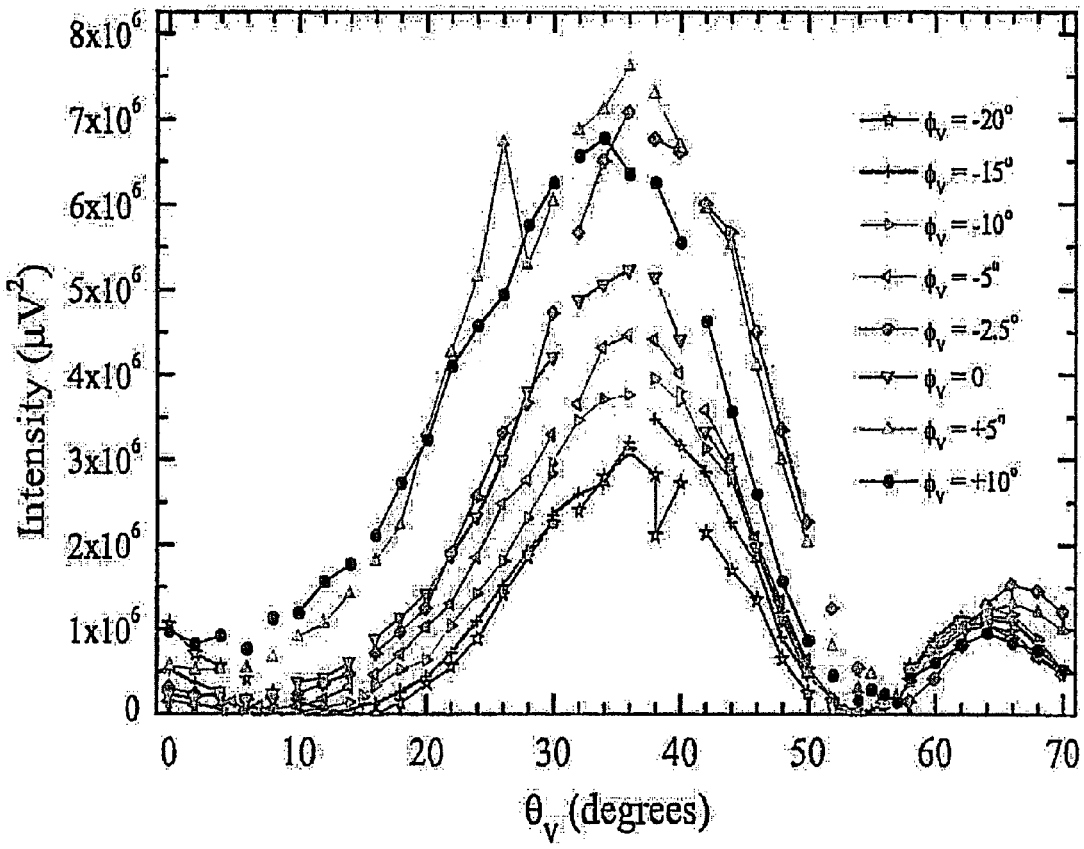
Figure 9B:
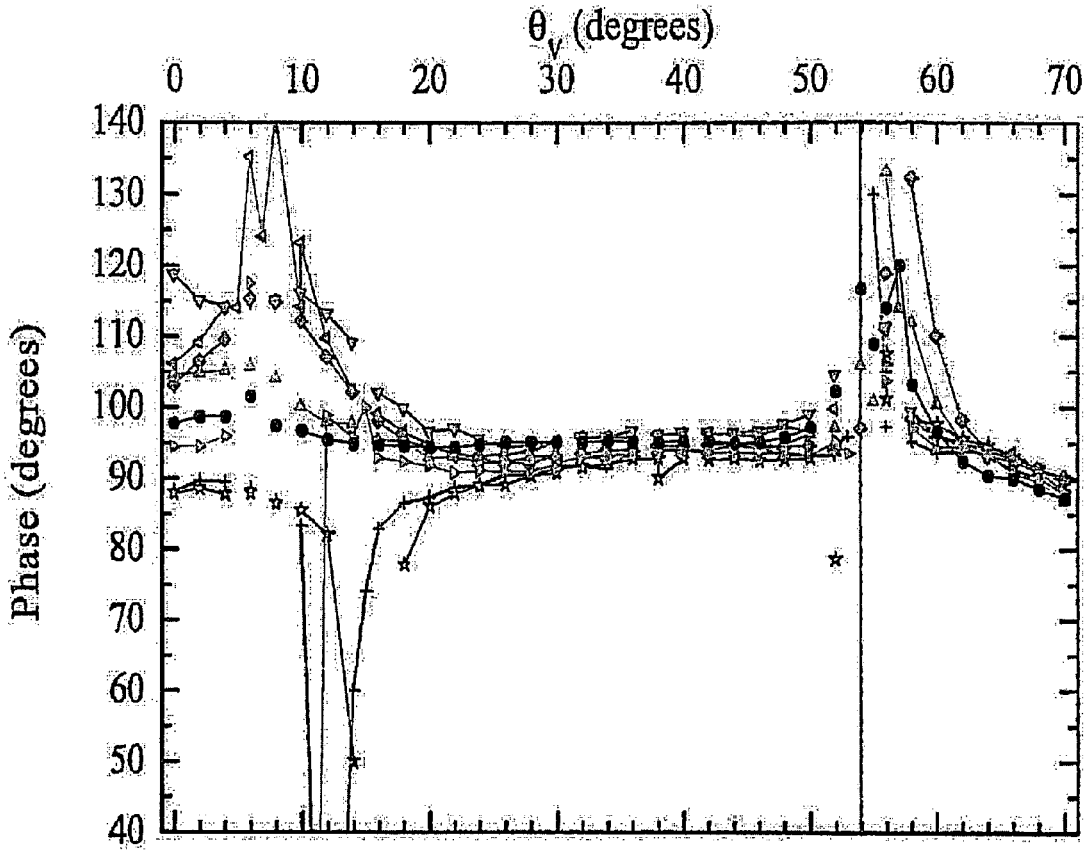
Figure 10A:
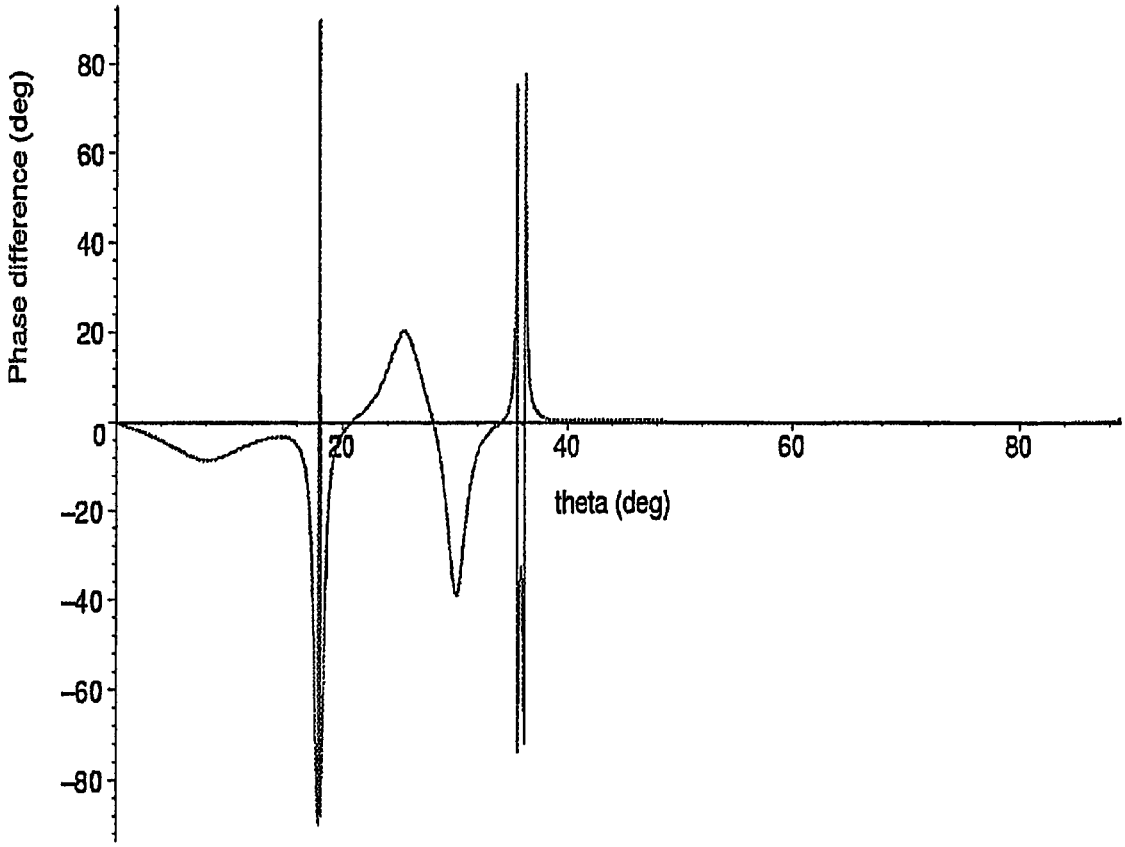
Figure 10B:
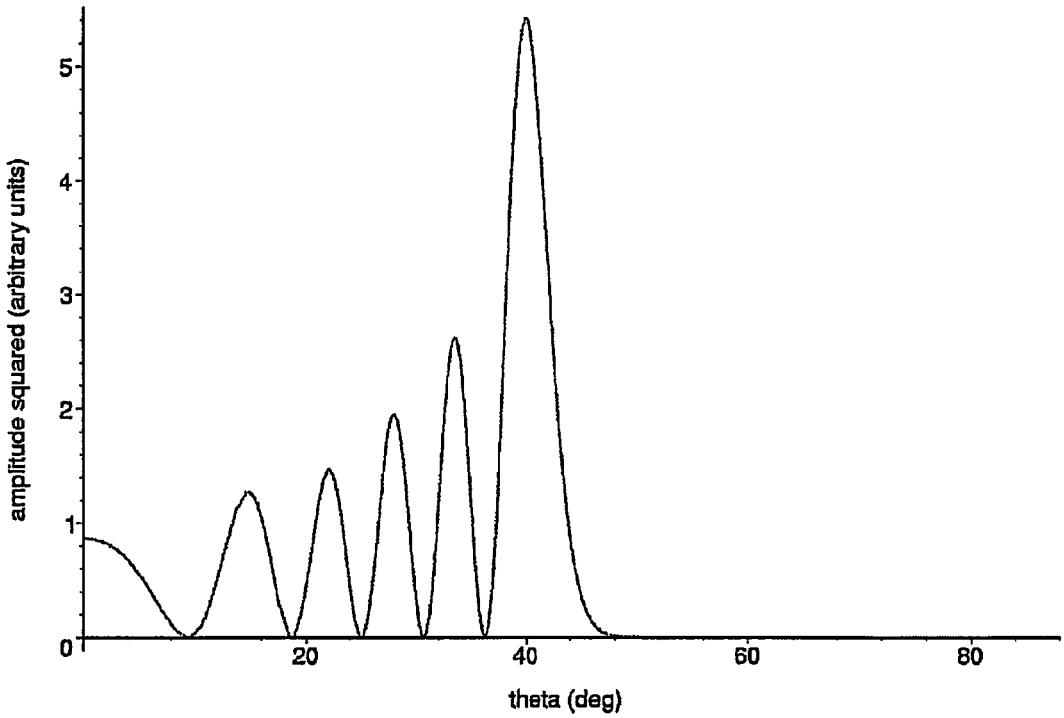

FIGS. 3(*a*) to 3(*d*) are graphical illustrations of the angular coordinates marking the spatial distribution of the radiation relative to the orientation of the array;

FIGS. 4(*a*) and 4(*b*) are graphical illustrations of a theoretical phase difference;

FIGS. 5(*a*), 5(*b*) and 5(*c*) are graphical illustrations of a theoretical phase difference;

FIGS. 6(*a*) and 6(*b*) are graphical illustrations of a theoretical phase difference;

FIGS. 7(*a*) and 7(*b*) are graphical illustrations of experimental and theoretical intensity and phase;

FIGS. 8(*a*) and 8(*b*) are graphical illustrations of experimental and theoretical intensity and phase;

FIGS. 9(*a*) to 9(*b*) are graphical illustrations of experimental and theoretical intensity and phase;

FIGS. 10(*a*) and 10(*b*) are graphical illustrations of experimental and theoretical intensity and phase for a full-circle array.

Figure 11A:
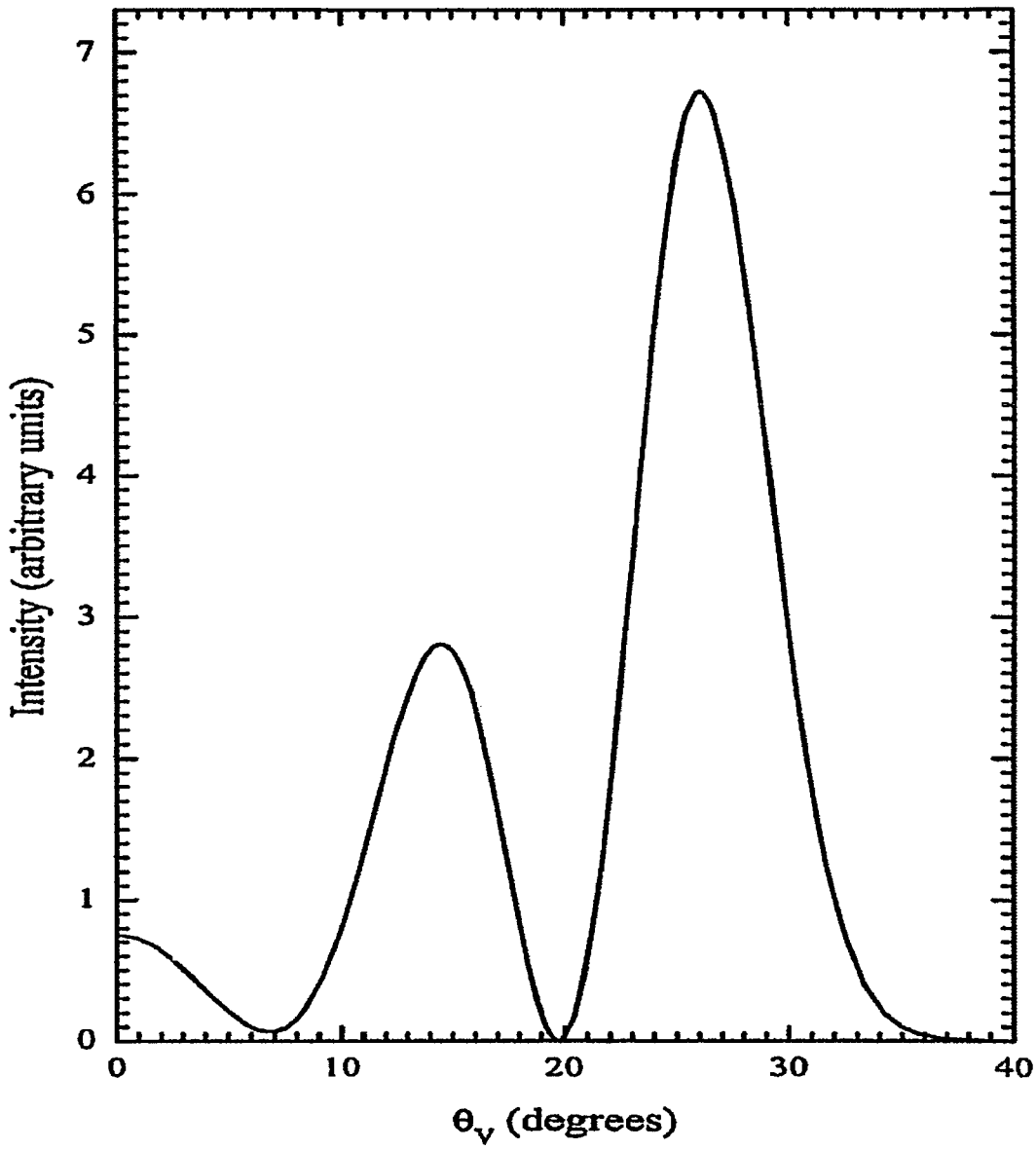
Figure 11B:
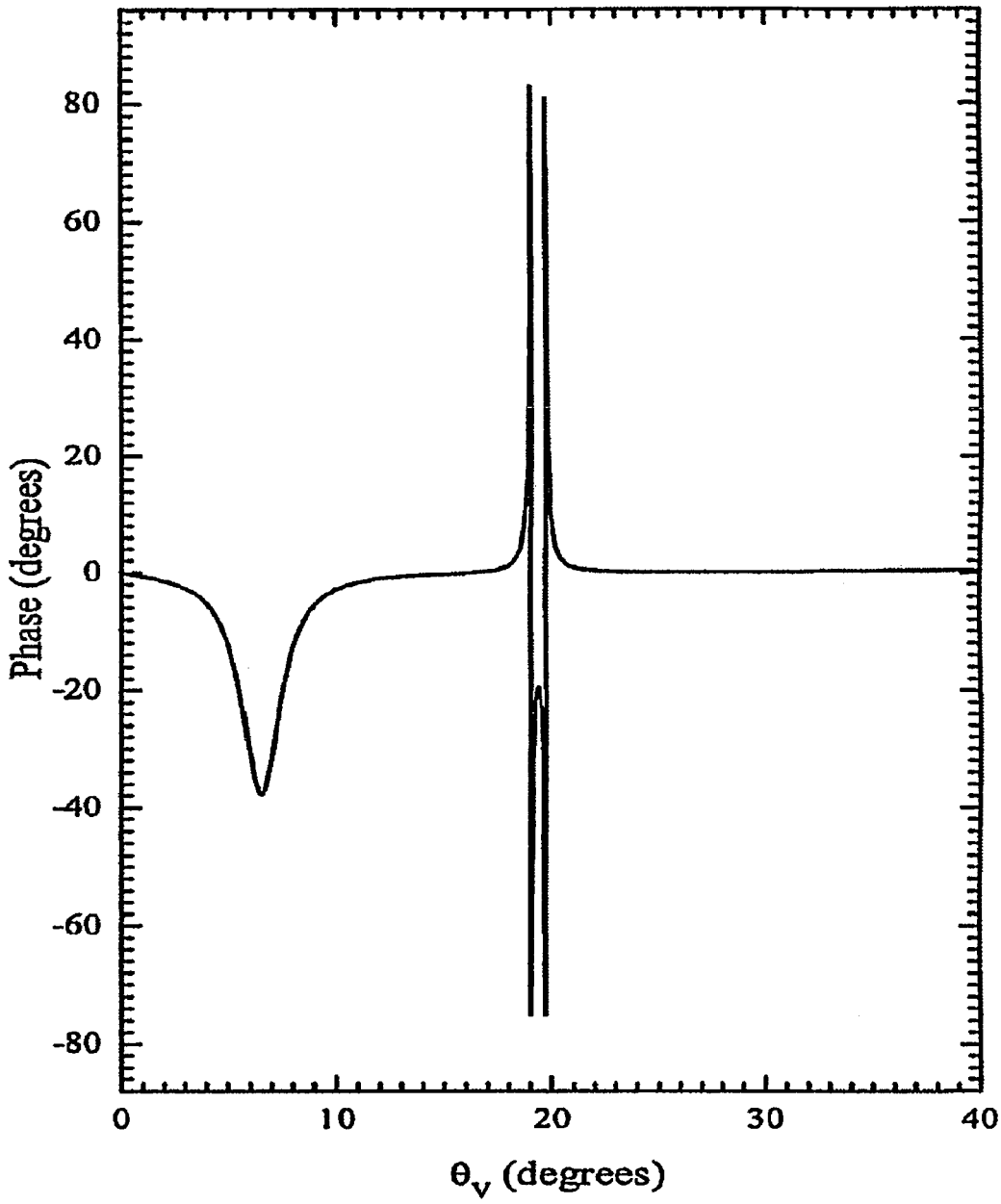

FIGS. 11(*a*) and 11(*b*) are illustrations of intensity and phase for a full-circle array.

While the invention is susceptible to various modifications and alterations and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the invention is to cover all modifications, equivalents, and alternatives falling within the spirit and scope of the present invention as defined by the appended claims.

5. DETAILED DESCRIPTION OF INVENTION

According to the embodiment(s) of the present invention, various views are illustrated in FIGS. 1-11 and like reference numerals are being used consistently throughout to refer to like and corresponding parts of the invention for all various views and figures of the drawing. Also, please note that the first digit(s) of the reference number for a given item or part of the invention should correspond to the Fig. number in which the item or part is first identified.

One embodiment of the present invention comprising an oscillating superluminal polarization current radiation source teaches a novel apparatus and method for emitting a complex phase front. The apparatus can include a dipole antenna array FIGS. 2(*c*), 2(*d*), 2(*e*), 2(*f*), (2(*g*)) having elements excited at predetermined phases including a curved solid dielectric strip 205 having negative 202 and positive 204 ions and having electrodes 210 coupled above and a ground plate 212 coupled below and said dielectric 205 having a finite polarization region 208, 214 created by selectively applying a spatially varying electric field by applying finite voltages 215 to a select group of electrodes where said voltages are produced by amplifiers 217 coupled to said electrodes 210 thereby polarizing the negative 202 and positive 204 ions of the dielectric 205. The amplifiers 217 can selectively vary, oscillate or switch on or off the voltages applied to the electrodes 210 to effect movement of the finite polarization region 208, 214 along the curved solid dielectric 205 introducing centripetal acceleration in the motion of the finite polarization region and creating a traveling wave oscillating superluminal polarization current 208 source.

The method can include the steps of selectively switching on or switching off a voltage input 215 to each of a plurality of element antenna amplifiers 217 in an array (FIGS. 2(*f*), 2(*g*)) each coupled to one of a plurality of metal electrodes 210 each coupled above a dielectric strip 205 having a continuous ground plate 212 coupled below said dielectric forming a series of amplifier-driven capacitative elements (FIGS. 2(*c*)-2(*f*)), thus applying a spatially varying field to the dielectric polarizing the positive and negative charges forming a finite polarization region (FIGS. 2(*b*)-2(*d*)). Then by selectively varying or switching on or switching off the voltage along the series of amplifier-driven capacitative elements (FIGS. 2(*c*), 2(*d*)) the polarization region 214 can be made to propagate (FIGS. 2(*b*), 2(*c*), 2(*d*)) creating a superluminal polarization current. The array can then be rotated 220 and radiation emitted generating a complex phase front.

The production and propagation of electromagnetic radiation is described by the following two Maxwell equations:

$$\nabla \times E = -\frac{\partial B}{\partial t}, \tag{4}$$

$$\nabla \times H = J_{free} + \epsilon_0 \frac{\partial E}{\partial t} + \frac{\partial P}{\partial t} \tag{5}$$

(SI units). Here H is the magnetic field strength, B is the magnetic induction, P is polarization, and E is the electric field; the (coupled) terms in B, E and H of Eqs. 4 and 5 describe the propagation of electromagnetic waves. The generation of electromagnetic radiation is encompassed by the source terms $J_{free}$ (the current density of free charges) and $\partial P/\partial t$ (the polarization current density); e.g., an oscillating $J_{free}$ is the basis of conventional radio transmitters. The charged particles that make up $J_{free}$ have finite rest mass, and therefore cannot move with a speed that exceeds the speed of light in vacuo; hence, practical superluminal sources employ a polarization current to generate electromagnetic radiation.

Figures 2A, 2B, 2C, 2D, 2E:
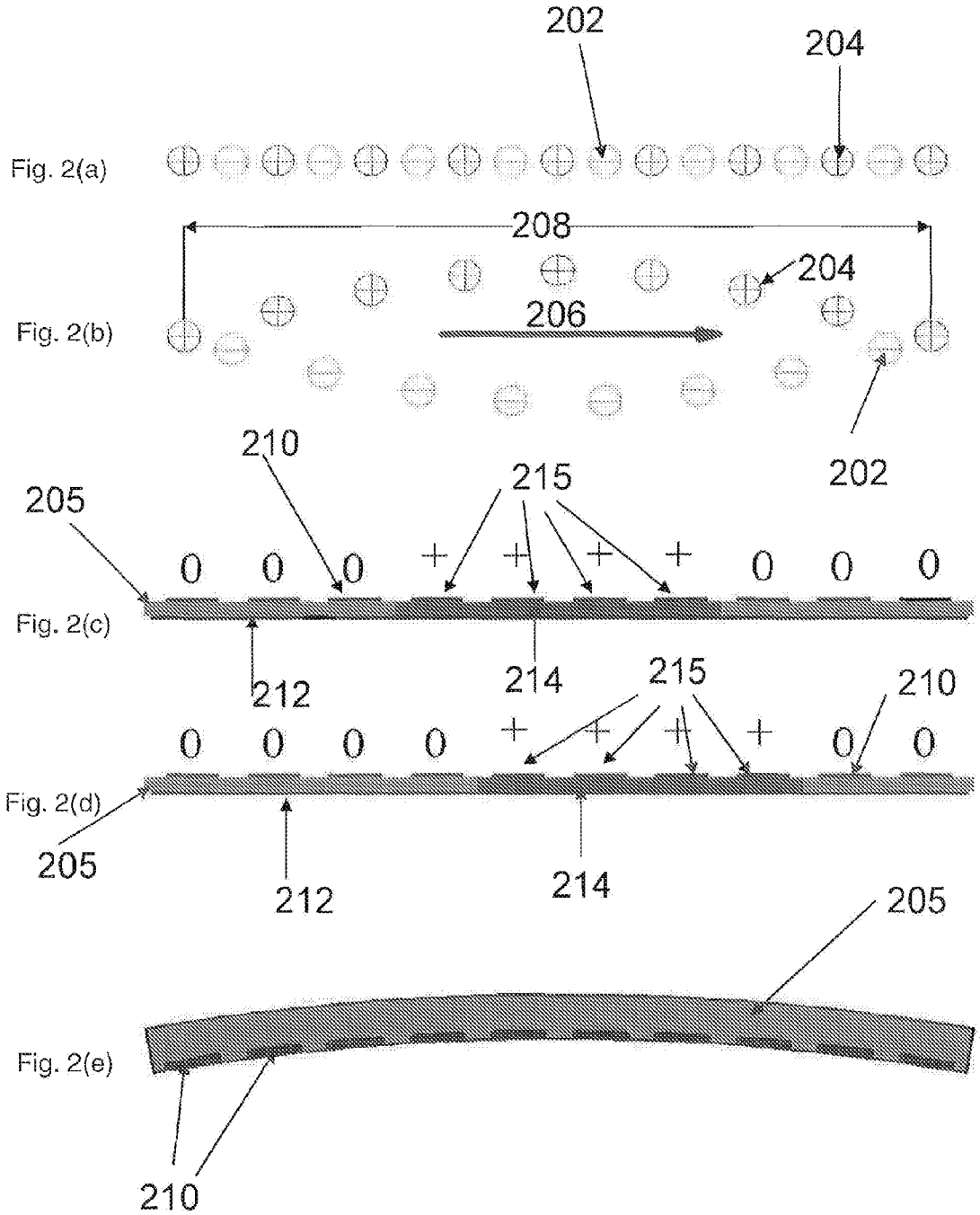
FIG. 2(*a*) is an illustration of positive and negative ions in a solid dielectric.
Figure 2F:
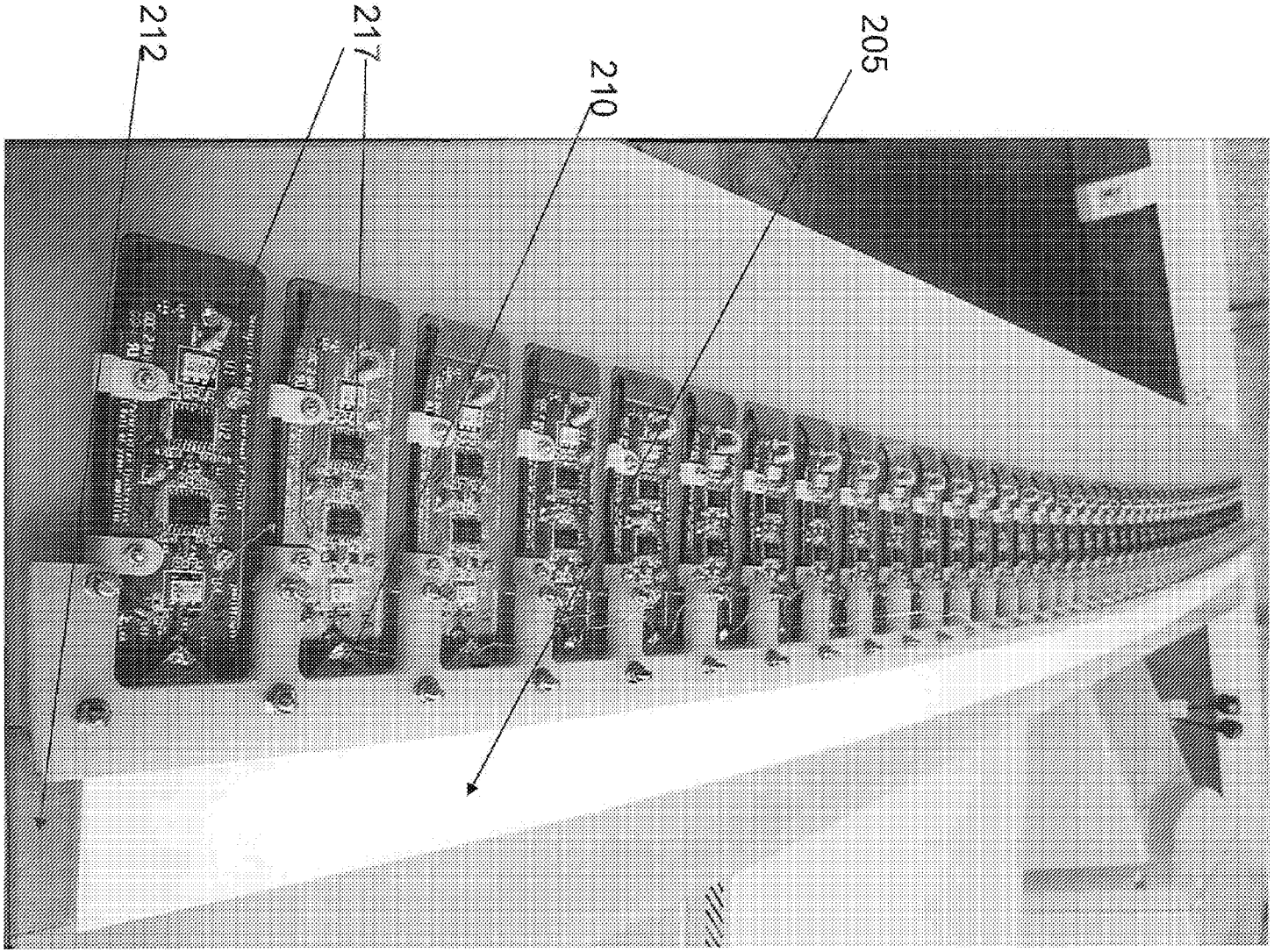
Figure 2G:
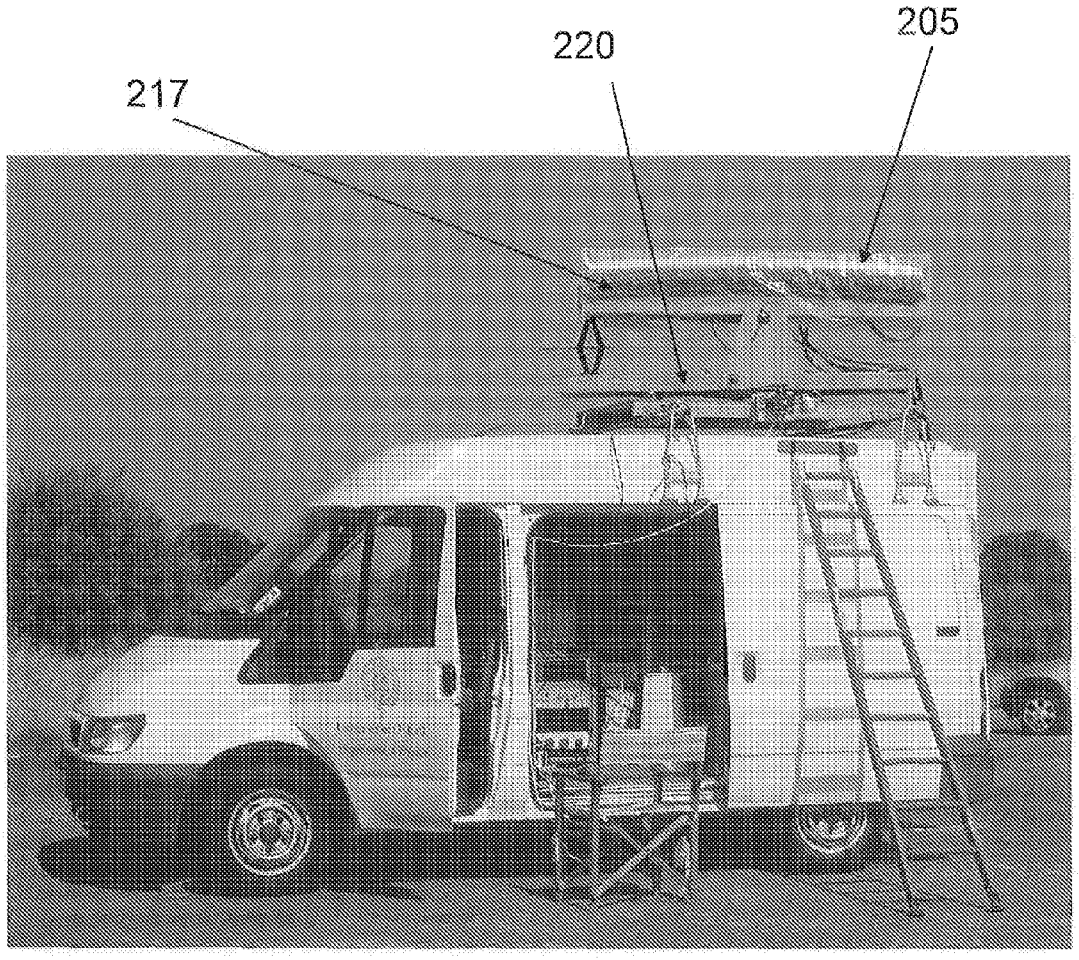

The principles of such sources are outlined in FIG. 2. FIG. 2(*a*)-(*b*) shows a simplified dielectric solid containing negative and positive ions. In (b), a spatially-varying electric field has been applied, causing the positive and negative ions to move in opposite directions. A finite polarization P has therefore been induced. If the distribution pattern of the spatially-varying field is made to move, the polarized region moves with it; we have a traveling "wave" of P (and also, by virtue of the time dependence imposed by movement, a traveling wave of $\partial P/\partial t$). Note that this "wave" can move arbitrarily fast (i.e. faster than the speed of light in vacuo) because the individual ions suffer only small displacements perpendicular to the direction of the wave and therefore do not themselves move faster than light.

The practical machine represents a discretized version of this process; it consists of a continuous strip of alumina (the material to be polarized by the applied electric field) on top of which is placed an array of metal electrodes; underneath is a continuous ground plate. This forms what is in effect a series of capacitors (a schematic is shown in FIG. 2(*c*)-(*e*)). Each upper capacitor electrode is connected to an individual amplifier FIG. 2(*f*)); varying the voltages provided by the amplifiers moves a polarized region along the dielectric (FIG. 2(*c*)-(*d*)). In addition, the dielectric is curved (FIG. 2(*e*)) to impart centripetal acceleration to the polarization current.

In practice, the dielectric in the experimental machine is a strip corresponding to approximately a 10° arc of a circle of approximate average radius a=10.025 m, made from alumina approximately 10 mm thick and 50 mm across. Above the alumina strip, there are 41 upper electrodes of mean width of approximately 42.6 mm, with centers approximately 44.6 mm apart (see photograph in FIG. 2). Whilst the ground plate is the same width as the dielectric strip, each electrode approximately covers only the inner 10 mm of the upper surface (shown schematically in FIG. 2(*e*)). This has the effect of producing a polarization in the alumina with both radial and vertical components. In what follows, we refer to the assembly of electrodes, ground plate and dielectric as "the array" for convenience.

A polarization current $j=\partial P/\partial t$ can be produced by a polarization (the electric dipole moment per unit volume) of the following form in the dielectric:

$$P_{r,\phi,z,t}(r,\phi,z,t)=s_{r,\phi,z}(r,z)\cos(m\hat{\phi})\cos(\Omega t); \tag{6}$$

here $P_{r,\phi,z}$ are the components of the polarization (expressed in cylindrical polar coordinates), s(r, z) is a vector field describing the orientation of P (it vanishes outside the active volume of the source), $\hat{\phi}$ stands for the Lagrangian coordinate $\phi-\omega t$, and $m\omega$ and $\Omega$ are the two angular frequencies used in the synthesis of the source.

One embodiment of the invention employs individual shielded amplifiers to drive each electrode of the array (see FIG. 2). This produces a stepped approximation to the sinusoidal polarization-current wave of Eq. 6 by supplying the jth (j=1, 2, 3 . . . ) electrode with a voltage $$V_j=V_0 \cos[\eta(j\Delta t-t)] \cos \Omega t. \tag{7}$$

Comparison of Eqs. 7 and 6 shows that $\eta \equiv m\omega$ and $\Delta t \equiv \Delta\phi/\omega$, where $\Delta\phi$ is the angle subtended by the effective center separation of adjacent electrodes. The speed $\upsilon$ with which the polarization current distribution propagates is set by adjusting $\Delta t$ to give $\upsilon=a\Delta\phi/\Delta t$, where a=10.025 m and $a\Delta\phi$=44.6 mm.

Given the dimensions of the experimental array, $\upsilon>c$ is achieved for $\Delta t<148.8$ ps. Most of the emission occurs at two frequencies, $f_{\pm}=|\Omega\pm\eta|/2\pi$. The current experiments use $\eta/2\pi$=552.654 MHz and $\Omega/2\pi$=47.321 MHz, so that the higher-frequency, $f_+=(\Omega+\eta)/2\pi$=599.975 MHz was approximately 25 kHz below 600.000 MHz.

The angular distribution of the radiation is measured by fixing the detector a distance R from the array and rotating the array about two orthogonal axes. As shown in FIG. 3, there are two possible configurations for these rotation axes. FIG. 3 also shows how the experimental coordinates are related to the theoretical coordinates used to describe the emission mechanism.

A general way of determining the phase $\gamma$ of an oscillating function f(t) at a given frequency is to expand f(t) once into a Fourier sine series and once into a Fourier cosine series and use $$\gamma=\arctan[\tilde{f}_s(\omega)/\tilde{f}_c(\omega)], \tag{8}$$

where $\tilde{f}_s(\omega)$ and $\tilde{f}_c(\omega)$ are the Fourier sine and Fourier cosine components of f(t) at the frequency $\omega$, respectively. An example is the basic monochromatic oscillation of Eq. 3;

$$V \equiv f=A\cos(\omega t-\gamma)=A[\cos\gamma\cos(\omega t)+\sin\gamma\sin(\omega t)], \tag{9}$$

whose Fourier sine and cosine series each consist of a single term with the components $$\tilde{f}_s(\omega)=A\sin\gamma \text{ and } \tilde{f}_c(\omega)=A\cos\gamma.$$

In the present case, we are interested in the phase of the electromagnetic waves that are generated by the polarization current $j=\partial P/\partial t$ defined by Eq. 6.

The electromagnetic fields E and B of the generated radiation are described, in the absence of boundaries, by $$E=\frac{1}{c^2}\int d^3x dt \frac{\delta(t_P-t-|x_P-x|/c)}{|x_P-x|}\hat{n}\times\left(\hat{n}\times\frac{\partial j}{\partial t}\right) \tag{10}$$

and $B=\hat{n}\times E$, where $(x_P, t_P)=(r_P, \phi_P, z_P, t_P)$ and $(x, t)=(r, \phi, z, t)$ are the space-time coordinates of the observation point and the source points, respectively, $n\equiv x_P/|x_P|$, $\delta$ is the Dirac delta function, and c is the speed of light in vacuo. (Here, we have set the origin of the coordinate system within the source so that $|x|<<|x_P|$ for an observation point in the radiation zone.)

The source term in the above expression has the following form for the polarization current $j=\partial P/\partial t$ described in Eq. 6:

$$\hat{n}\times\left(\hat{n}\times\frac{\partial j}{\partial t}\right)=\frac{1}{2}\omega^2\sum_{\mu=\mu\pm}\mu^2\cos\left(\frac{\mu\hat{\varphi}-\Omega\varphi}{\omega}\right)\times\{[s_r\sin(\varphi-\varphi_P)+s_\varphi\cos(\varphi-\varphi_P)]\hat{e}_{\parallel}+[s_\phi\cos\theta_P\sin(\phi-\phi_P)-s_r\cos\theta_P\cos(\phi-\phi_P)+s_z\sin\theta_P]\hat{e}_{\perp}\},\tag{11}$$

where $\mu_\pm\equiv\Omega/\omega\pm m$. In this expression, $\hat{e}_{\parallel}$, which is parallel to the plane of rotation pointing along the cylindrical base vector $\hat{e}_{\phi P}$, and $\hat{e}_{195}\equiv\hat{n}\times\hat{e}_{\parallel}$ comprise a pair of unit vectors normal to the radiation direction $\hat{n}$. The detectors were set to measure the component of the radiation that is polarized parallel to the plane of the array. Hence the relevant component of the source term in Eq. 10 is $$\hat{e}_{\parallel}\cdot\left[\hat{n}\times\left(\hat{n}\times\frac{\partial j}{\partial t}\right)\right]=\frac{1}{2}\omega^2 s_r\sin(\varphi-\varphi_P)\sum_{\mu=\mu\pm}\mu^2\cos\left(\mu\hat{\varphi}-\frac{\Omega_\varphi}{\omega}\right)\tag{12}$$

in the case of the present experimental array for which $s_\phi$ is zero.

The fact that the array has the form of an arc (FIGS. 2 and 3) means that the domain of integration in Eq. 10 consists, in the present case, of the cylindrical strip $-5°<\phi<5°$, 10.00 m<r<10.05 m, −0.005 m<z<0.005 m, that bounds the volume occupied by the dielectric. Since the r and z dimensions of this volume are appreciably shorter than the wavelengths at which the radiation is generated and measured in the present experiments (approximately 0.50 m and 0.59 m), the integration with respect to these two coordinates may be omitted when evaluating the integral in Eq. 10 without introducing any significant error. Inserting Eq. 12 in Eq. 10 and changing the remaining variables of integration ($\phi$, t) to ($\phi$, $\hat{\phi}$), we find that the component of the electric field in the direction of $\hat{e}_{\parallel}$ is given by $$E(R_P,\theta_P,\varphi_P,t_P)\propto\sum_{\mu=\mu\pm}\mu^2\int d\varphi\int d\hat{\varphi}\sin(\varphi-\varphi_P)\times\cos\left(\frac{\mu\hat{\varphi}-\Omega\varphi}{\omega}\right)\delta(\hat{R}+\varphi-\hat{\varphi}-\omega t_P)/\hat{R},\tag{13}$$

to within a constant of proportionality depending on the source strength. Here, $$\hat{R}\equiv|x_P-x|\omega/c=\left[\hat{R}_P^2+\hat{r}^2-2\hat{r}\hat{R}_P\sin\theta_P\cos(\varphi_P-\varphi)\right]^{\frac{1}{2}},\tag{14}$$

in which $\hat{r}\equiv r\omega/c\equiv\upsilon/c$ is the source speed in units of c, $\hat{R}_P\equiv R_P\omega/c=(r_P^2+z_P^2)^{1/2}\omega/C$, and $\theta_P=\arccos(z_P/R_P)$ [i.e., ($R_P$, $\theta_P$, $\phi_P$) comprise the spherical coordinates of the observation point P in units of the light-cylinder radius c/ω]. The integration with respect to $\phi$ extends over the interval (−π/36, π/36), and the integration with respect to $\hat{\phi}$ may be performed over any interval of length 2π in which the argument of the delta function has a zero (see below).

Measurements are made at the frequency $\mu_+\omega\equiv\eta+\Omega$. The coefficient corresponding to this frequency in the Fourier cosine series for $E(x_P, t_P)$ has the value $$\tilde{E}_c(x_P,\mu_+\omega)=\left(\frac{\mu_+\omega}{\pi}\right)\int_{-\pi/(\mu_+\omega)}^{\pi/(\mu_+\omega)}dt_P\cos(\mu_+\omega t_P)E(R_P,\theta_P,\phi_P,t_P)\propto\sum_{\mu=\mu\pm}\mu^2\int d\varphi\int d\hat{\varphi}\left[\frac{\sin(\varphi-\varphi_P)}{\hat{R}}\right]\cos\left(\frac{\mu\hat{\varphi}-\Omega\varphi}{\omega}\right)\cos[\mu_+(\hat{R}+\varphi-\hat{\varphi})]\times\left[\mathcal{H}\left(\frac{\pi}{\mu_+-\hat{R}-\varphi+\hat{\varphi}}\right)-\mathcal{H}\left(\frac{-\pi}{\mu_+-\hat{R}-\varphi+\hat{\varphi}}\right)\right],\tag{15}$$

where H stands for the Heaviside step function. The second line in this equation follows from inserting the expression for $E(R_P, \theta_P, \phi_P, t_P)$ in its first line, interchanging the orders of integration with respect to $t_P$ and ($\phi$, $\hat{\phi}$), and evaluating the integral over $t_P$ first.

The above step functions (arising from the integration of the delta function over a finite interval) require that the values of $\hat{\phi}$ should be limited to the following interval:

$$\hat{R}+\phi-\pi/\mu_+<\hat{\phi}<\hat{R}+\phi+\pi/\mu_+.\tag{16}$$

Once the integration with respect to $\hat{\phi}$ is carried out over this interval, one obtains $$\tilde{E}_c(x_P,\mu_+\omega)\propto\int_{-\pi/36}^{\pi/36}d\varphi\frac{\sin(\varphi-\varphi_P)}{\hat{R}}\left\{\mu_+^2\cos(\mu_+\hat{R}+m\varphi)+\mu_-^2\left[\frac{\mu_+}{2m\pi}\sin\left(\frac{2m\pi}{\mu_+}\right)+\frac{\mu_+\omega}{2\pi\Omega}\sin\left(\frac{2\pi\Omega}{\mu_+\omega}\right)\right]\cos(\mu_-\hat{R}-m\varphi)\right\},\tag{17}$$

an integral that has to be evaluated numerically.

The corresponding coefficient in the Fourier sine series for $E(x_P, t_P)$ has the value $$\tilde{E}_s(x_P,\mu_+\omega)=\left(\frac{\mu_+\omega}{\pi}\right)\int_{-\pi/(\mu_+\omega)}^{\pi/(\mu_+\omega)}dt_P\sin(\mu_+\omega t_P)E(R_P,\theta_P,\phi_P,t_P)\propto\sum_{\mu=\mu\pm}\mu^2\int d\varphi\int d\hat{\varphi}\left[\frac{\sin(\varphi-\varphi_P)}{\hat{R}}\right]\cos\left(\frac{\mu\hat{\varphi}-\Omega\varphi}{\omega}\right)\sin[\mu_+(\hat{R}+\varphi-\hat{\varphi})]\times\left[\mathcal{H}\left(\frac{\pi}{\mu_+-\hat{R}-\varphi+\hat{\varphi}}\right)-\mathcal{H}\left(\frac{-\pi}{\mu_+-\hat{R}-\varphi+\hat{\varphi}}\right)\right].\tag{18}$$

The same procedure that led to Eq. 17 now results in $$\tilde{E}_s(x_P,\mu_+\omega)\propto\int_{-\pi/36}^{\pi/36}d\varphi\frac{\sin(\varphi-\varphi_P)}{\hat{R}}\left\{\mu_+^2\sin(\mu_+\hat{R}+m\varphi)+\mu_-^2\left[\frac{\mu_+}{2m\pi}\sin\left(\frac{2m\pi}{\mu_+}\right)-\frac{\mu_+\omega}{2\pi\Omega}\sin\left(\frac{2\pi\Omega}{\mu_+\omega}\right)\right]\sin(\mu_-\hat{R}-m\varphi)\right\}.\tag{19}$$

Note that the expression in Eq. 19 differs from that in Eq. 17 not only in that $\cos(\mu_\pm\hat{R}\pm m\phi)$ are replaced by $\sin(\mu_\pm\hat{R}\pm m\phi)$, but also in that the sign of the second term in the square brackets is changed.

The phase of the waves that are detected at the observation point P are therefore given, according to Eq. 8, by $$\gamma_P = \arctan\left[\frac{\tilde{E}_s(x_P, \mu_+\omega)}{\tilde{E}_c(x_P, \mu_+\omega)}\right] \tag{20}$$

and Eqs. 17 and 19. Comparing this with the phase of the waves that are detected at a neighbouring point Q with the coordinates ($R_Q$, $\theta_Q$, $\phi_Q$), we find that the phase difference is represented by $$\Delta\gamma \equiv \gamma_P - \gamma_Q = \arctan\left[\frac{\tilde{E}_s(x_P, \mu_+\omega)\tilde{E}_c(x_Q, \mu_+\omega) - \tilde{E}_c(x_P, \mu_+\omega)\tilde{E}_s(x_Q, \mu_+\omega)}{\tilde{E}_c(x_P, \mu_+\omega)\tilde{E}_c(x_Q, \mu_+\omega) + \tilde{E}_s(x_P, \mu_+\omega)\tilde{E}_s(x_Q, \mu_+\omega)}\right]. \tag{21}$$

This phase difference can be expressed in terms of the experimentally measured coordinates ($R^{(P)}$, $\theta_V^{(P)}$, $\Phi_V^{(P)}$) and ($R^{(Q)}$, $\theta_V^{(Q)}$, $\Phi_V^{(Q)}$) of the points P and Q by means of the following transformations:

$$R_O = (R^{(O)2} + a^2 + 2aR^{(O)}\cos\vartheta_V^{(O)}\sin\phi_V^{(O)})^{1/2}, \tag{22}$$

$$\theta_O = \arccos\left(-\frac{R^{(O)}}{R_O}\sin\vartheta_V^{(O)}\right), \tag{23}$$

$$\varphi_O = -3\pi/2 - \arctan\left(\tan\phi_V^{(O)} + \frac{a}{R^{(O)}\cos\vartheta_V^{(O)}\cos\phi_V^{(O)}}\right), \tag{24}$$

in which O can be either P or Q, and a=10.025 m is the average radius of the array.

FIG. 4 shows the results of this calculation for typical practical source-detector distances R and for the same source dimensions as the experimental machine. The source speed was $\upsilon/c=1.25$; $R^{(P)}=R^{(Q)}=R$, with a tangential separation $R|\theta_V^{(P)}-\theta_V^{(Q)}|$ of 12 m between P and Q. The orientation of the array is described by the experimental coordinates $\theta_V$ and $\Phi_V$ (see FIG. 3), with $\Phi_V=-5°$. Note the complexity of the phase difference $\Delta\gamma$ as a function of both R and $\theta_V$, especially at either side of the direction of maximum emitted power at this source speed.

The expressions in Eqs. 17 and 19 describe the electric-field vector of the wave that propagates from the source to the detector directly. In the presence of the ground, we need to take into account also the electric-field vector of the reflected wave that passes through the observation point P. This may be done by replacing $\tilde{E}_s(x_P, \mu_+\omega)$, $\tilde{E}_c(x_P, \mu_+\omega)$, $\tilde{E}_s(x_Q, \mu_+\omega)$ and $\tilde{E}_c(x_Q, \mu_+\omega)$ everywhere by $$\sin(\phi_P+\Phi_0)\tilde{E}_s(x_P,\mu_+\omega)+q_{\parallel}^{(P)}\sin(\phi_P+\Phi_0)\tilde{E}_s(x_{P'},\mu_+\omega), \tag{25}$$

$$\sin(\phi_P+\Phi_0)\tilde{E}_c(x_P,\mu_+\omega)+q_{\parallel}^{(P)}\sin(\phi_P+\Phi_0)\tilde{E}_c(x_{P'},\mu_+\omega), \tag{26}$$

$$\sin(\phi_Q+\Phi_0)\tilde{E}_s(x_Q,\mu_+\omega)+q_{\parallel}^{(Q)}\sin(\phi_Q+\Phi_0)\tilde{E}_s(x_{Q'},\mu_+\omega), \tag{27}$$

and $$\sin(\phi_Q+\Phi_0)\tilde{E}_c(x_Q,\mu_+\omega)+q_{\parallel}^{(Q)}\sin(\phi_Q+\Phi_0)\tilde{E}_c(x_{Q'},\mu_+\omega), \tag{28}$$

respectively, where P' and Q' are the images of the observation points P and Q across the surface of the ground, and $\Phi_0$ specifies the inclination of the array with respect to this surface. Here, $$q_{\parallel}^{(O)} = \frac{N^2\cos\alpha^{(O)} - (N^2 - \sin^2\alpha^{(O)})^{\frac{1}{2}}}{N^2\cos\alpha^{(O)} + (N^2 - \sin^2\alpha^{(O)})^{\frac{1}{2}}} \tag{29}$$

is the relevant Fresnel coefficient for reflections off a medium with the index of refraction N, where $$\alpha^{(O)}=\arctan\{[R^{(O)2}-(h_D^{(O)}-h_A)^2]^{1/2}/(h_D^{(O)}+h_A)\}, \tag{30}$$

O stands for P or Q, and $h_A$ and $h_D^{(O)}$ are the heights of the array and the detector at O, respectively. The coordinates of the image points P' and Q' are given, in terms of the experimentally measured coordinates of the detectors P and Q, by the following relationships:

$$R_{O'} = \left[R^{(O)2} + a^2 + +(2h_D^{(O)})^2 - 4ah_D^{(O)}\cos\phi_0 + 2aR^{(O)}\cos\vartheta_V^{(O)}\sin\phi_V^{(O)} - 4h_D^{(O)}R^{(O)}\cos\vartheta_V^{(O)}\sin(\phi_V^{(O)} - \phi_0)\right]^{1/2}, \tag{31}$$

$$\theta_{O'} = \arccos\left(-\frac{R^{(O)}}{R_{O'}}\sin\vartheta_V^{(O)}\right), \tag{32}$$

$$\varphi_{O'} = -3\pi/2 - \arctan\left(\frac{R^{(O)}\cos\vartheta_V^{(O)}\sin\phi_V^{(O)} + a - 2h_D^{(O)}\cos\phi_0}{R^{(O)}\cos\vartheta_V^{(O)}\cos\phi_V^{(O)} + 2h_D^{(O)}\sin\phi_0}\right), \tag{33}$$

in which O' can be either P' or Q'.

FIGS. 5 and 6 show the results of this calculation with the index of refraction N=1.1 for typical practical source-detector distances R and for the same source dimensions as those above. The source speed was $\upsilon/c=1.25$; $R^{(P)}=R^{(Q)}=R$, with a tangential separation $R|\theta_V^{(P)}-\theta_V^{(Q)}|$ of 12 m between P and Q. The orientation of the array is described by the experimental coordinates $\theta_V$ and $\Phi_V$ (see FIG. 3). Note that the inclusion of reflection from the ground has not detracted from the complexity of the phase difference as a function of R and $\theta_V$ (see FIG. 4); such complexity is an intrinsic characteristic of rotating superluminal sources, for which there is no simple relationship between emission time and reception time.

To obtain the intensity of the radiation from the expressions in Eqs. 17 and 19, it would be necessary to integrate $\tilde{E}_c^2+\tilde{E}_s^2$ with respect to the frequency $\mu_+\omega$ over the bandwidth of the receiver.

Measurements were performed at the upper frequency, $f_+=(\Omega+m\omega)/2\pi\equiv(\Omega+\eta)/2\pi$. The detection system works at frequencies close to 600 MHz, and is based on two identical dipole aerials, each mounted at a height $h_D$=2 m above the ground on adjustable tripod masts; the aerials P and Q. Each aerial is connected to a Group A and a Group B band-pass filter in series, to eliminate spurious signals away from 600 MHz; the filtered signals from P and Q are then amplified using two identical Maxview Triax MHF 3553 amplifiers. For the phase analysis, the output from each amplifier is individually mixed with a 600.000 MHz signal from a Minicircuits 2X05-C24MH resistive splitter driven by an Atlantec ANS2-0500-10-0 oscillator. The resulting 25 kHz signal from P was amplified using an EG and G 5113 amplifier to provide the reference phase for a Stanford Research SR830 DSP lock-in amplifier, the signal channel of which was connected to the 25 kHz signal from Q. As the mixing preserves the relative phases of P and Q, the phase difference between the signal and reference channels of the lock-in is, to within a constant offset dependent on the electronics, identical to the phase difference between the $f_+$ signals at the two aerials. The amplitude and phase outputs of the lock-in amplifier were recorded; the intensity plotted in the following figures is proportional to the square of the amplitude. Note that for each measurement distance R, the phase measurement contains a systematic constant offset associated with the electronics and slight errors in the relative positioning of P and Q (i.e. $R^{(P)}$ and $R^{(Q)}$ are not quite equal—the error will typically be ~0.5 m in distances R~500 m).

The array was mounted in the configuration shown in FIG. 3(*a*) at a height $h_A$=3.48 m above the ground, and the measurements made.

FIG. 7 shows typical experimental results in the form of intensity and phase data for a source speed of $\upsilon/c$=1.25, an array to detector distance of $R=R^{(P)}=R^{(Q)}$=980 m and a tangential P-Q antenna separation of $R|\theta_V^{(P)}-\theta_V^{(Q)}|$=12 m plotted as a function of $\theta_V$ for $\Phi_V$=−10°, −5°, 0, 5° and 10°. Note that the phase shows strong excursions around the minima in intensity. Moreover, there is a vertical offset between phase data on either side of the intensity minimum, behaviour that is very distinct from that of a phased array. The continuous curves in FIG. 7 show the predictions of the model. Note that the theoretical curves reproduce the data in a quantitative fashion; adjustments of the order of 1° from the expected values of ($\theta_V$, $\Phi_V$), and departures of less than 0.05 m in the value of $|R^{(P)}-R^{(Q)}|$ from zero, have been sufficient to obtain the depicted agreement between model and data.

In particular, the coincidence of the strong phase excursions with the minima in intensity is a feature that can be directly inferred from Eq. 21. The vanishing of the denominator of the fraction in Eq. 21, which occurs close to a zero of intensity (for a small P-Q separation), would imply a shift from $-\pi/2$ to $\pi/2$ (or from $\pi/2$ to $-\pi/2$) in the value of $\Delta\gamma$ if it occurs simultaneously with a change in the sign of the numerator of this fraction. In general, a change in the sign of the numerator of the fraction in Eq. 21 is not necessarily concurrent with the vanishing of the denomenator of this fraction. Correspondingly, the observed shift in the value of $\Delta\gamma$, though attaining its largest values in the vicinities of the zeros of intensity, is not as large as $\pi$ in general.

FIG. 8 shows comparable data for a source speed of $\upsilon/c$=1.063. The same trends are apparent, except that the maximum intensity is shifted to lower values of $\theta_V$, in agreement both with theoretical expectations and experiments. There are large phase variations at only one value of $\theta_V$ because these data do not include the intensity minima that occur at higher latitudes. In modeling the experimental data of FIG. 8, it has been necessary to shift the expected values of the parameter $\Phi_0$ by −6.5° systematically. Given that adjustments in the value of $\Phi_0$ only influence the reflected signal (by effectively adjusting the inclination of a notional image source), this may be an indication that the effect of the ground needs to be modeled more accurately in cases where $\upsilon/c$ is close to 1.

FIG. 9(*a*) shows experimental intensity and phase data for a source speed of $\upsilon/c$=1.063, an array to detector distance of $R=R^{(P)}=R^{(Q)}$=180 m and a tangential P-Q antenna separation of $R|\theta_V^{(P)}-\theta_V^{(Q)}|$=3 m plotted as a function of $\theta_V$ for several values of $\Phi_V$. The data show that the characteristic phase variations observed at larger distances persist down to 180 m. Neither these nor the theoretical model indicate any characteristic trait of the phase fronts that evolves with distance.

FIG. 9(*b*) displays experimental intensity and phase data for a source speed of $\upsilon/c$=1.063 and an array to detector distance of $R=R^{(P)}=R^{(Q)}$=404 m as a function of $\theta_V$ for tangential P-Q antenna separations of 3 m, 5.9 m and 12 m. It shows that the observed differences in phase are essentially independent of the tangential separation of P and Q in regions where $|\gamma_P-\gamma_Q|$ varies slowly with $\theta_V$. This, and the fact that the phase differences are more sensitively dependent on the P-Q separation close to the minima of the amplitude, are both corroborated by the theoretical model.

In summary, the experimental data show extensive and continuous variations of the phase difference $\gamma_P-\gamma_Q$ both as a function of the polar ($\theta_V$) and azimuthal ($\Phi_V$) angles and of the source to detector distance (R). This indicates that the phase fronts from a superluminal source undergoing centripetal acceleration possess considerable complexity, in contrast to those from conventional phased-array systems. A relatively simple radar system based on a superluminal source would therefore be less vulnerable to countermeasures than conventional systems based on phased arrays.

Finally, note that the theoretical model is able to reproduce the experimental data quantitatively. This shows that the model is a good representation of the properties of superluminal sources, and that our understanding of this novel area of electromagnetism is valid.

The array of the current experimental superluminal source (see FIG. 2) represents only a short arc of a circle. Significant advantages can be gained in alternative embodiment machines by using an array that is a full circle. FIGS. 10 and 11 show the predicted intensity and phase for such a machine; in both simulations, free-space propagation (i.e. no reflections from the ground) has been assumed. To allow a direct comparison of these figures with the corresponding predictions for the 10° arc that appear in FIGS. 7, 8 and 9, the same coordinates ($\theta_V$ and $\Phi_V$) and the same parameters as in the earlier figures have been adopted. In both figures, the source to detector distance is $R=R^{(P)}=R^{(Q)}$=979.6 m, the tangential detector separation is $R|\theta_V^{(P)}-\theta_V^{(Q)}|$=12 m and $\Phi_V$=0. The source speed is $\upsilon/c$=1.25 in FIG. 10 and $\upsilon/c$=1.063 in FIG. 11.

FIGS. 10 and 11 show that the far-field value of the phase difference $\Delta\gamma$ does not vary with $\theta_V$ outside the envelope of wave fronts, i.e. for $\theta_V \geqq \arccos(c/\upsilon)$ and $R \gg c/\omega$. This is because the reception time $t_P$ is a multi-valued function of the emission time t only inside the envelope of wave fronts. In addition to the vanishing of $\Delta\gamma$ outside the envelope of wave fronts, where $t_P$ has the same monotonic dependence on t as in a conventional source, the amplitude of the signal is negligibly small beyond $\theta_V=\arccos[(\eta/f_+)(c/\upsilon)]$.

Hence, the range of $\theta_V$ in which the phase variations occur would coincide with that in which the amplitude attains its extrema if the source is synthesized with a frequency $\Omega \equiv f_+-\eta$ that is much lower than $\eta$.

Note that, in practice, the extent of the angular region (in $\theta_V$) over which the phase and amplitude variations occur can be made as small, or as large, as desired by the choice of the two parameters $\upsilon/c$ and $\eta/f_+$. In particular, it would be possible to generate a radiation beam propagating into the plane of rotation ($\theta_V$=0) with an arbitrarily narrow width in $\theta_V$ by choosing the value of $\upsilon/c$ close to unity. This radiation would be distributed over all values of $\Phi_V$ when the azimuthal variation of the source density is sinusoidal as in Eq. 6. To generate a corresponding radiation that is beamed in $\Phi_V$, as well as in $\theta_V$, we would have to synthesize a superluminal source whose distribution pattern is localized (rather than sinusoidally varying) in $\hat{\phi}$.

The present invention considers the phase fronts associated with the spherically-decaying component of the radiation that is generated by a superluminal source. The radiation that arises from the present source also entails a nonspherically-decaying component, a tightly beamed component that is composed of the collection of cusps of the wave fronts emanating from each source element. Given the crucial role played by the phases of the constructively interfering waves that form the cusps, a similar investigation of the characteristics of the phase difference $\Delta\gamma$ for the nonspherically-decaying component of the radiation is essential to further development of the present invention.

A full-circle array would be more suited to such an investigation because, as illustrated by FIGS. 10 and 11, it would generate a spherically-decaying radiation for which the phase difference $\Delta\gamma$ will be distinctly different inside and outside the space occupied by the envelopes of wave fronts. The locus of cusps lies at the inner boundary of the region $\theta_V \geqq \arccos(c/\upsilon)$ in which the phase difference $\Delta\gamma$ vanishes. This delineation of the space occupied by the envelopes of wave fronts should therefore make it much easier to locate the cusps in experiments. (The cusps occupy a very narrow interval in $\theta_V$; those generated by the arc array that is used in the present experiments, for example, lie within an angular interval of ~1° at a distance of ~500 m.)

Figures 1A, 1B:
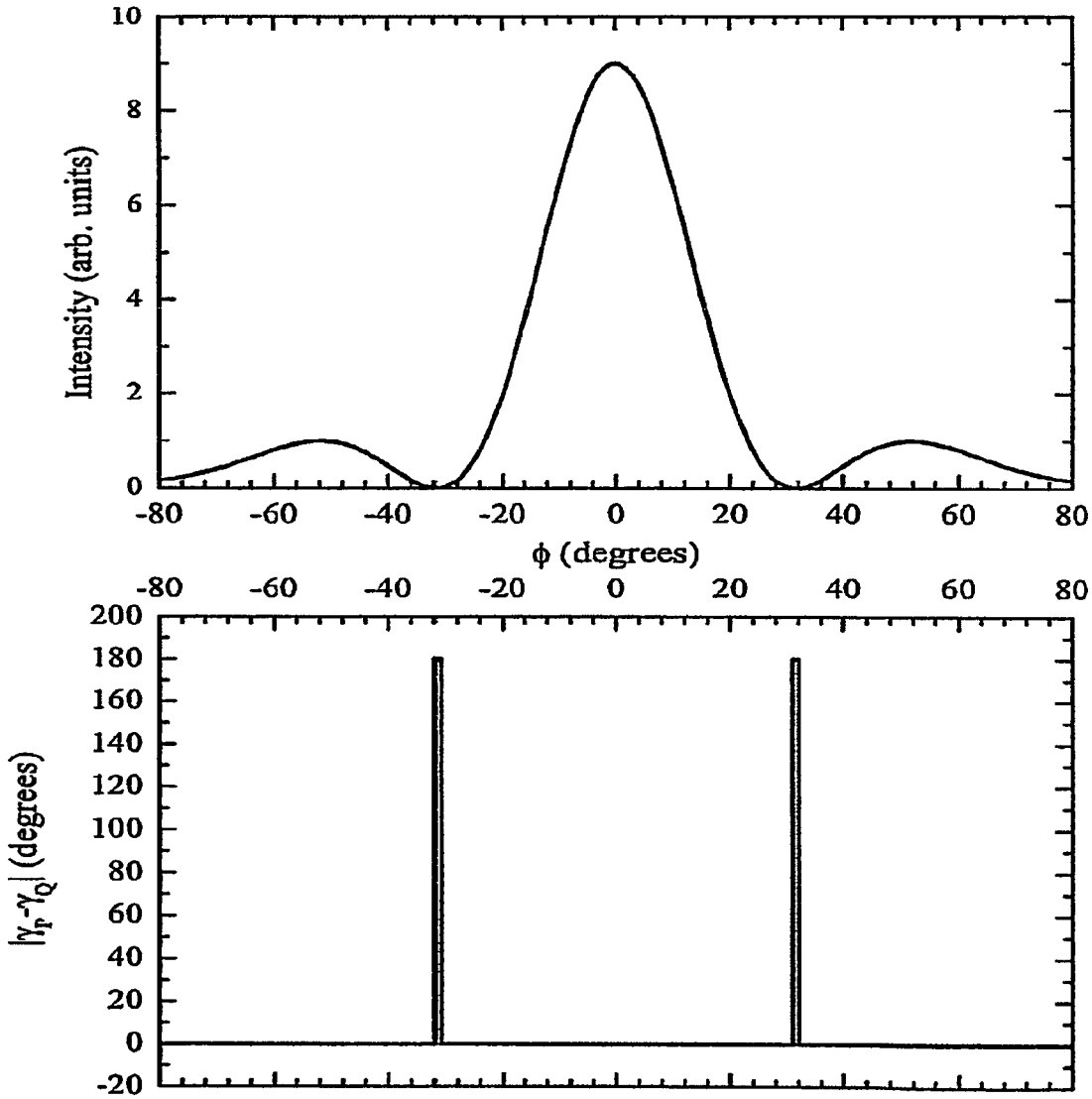
FIG. 1 is a graph of the simulated intensity and phase difference for a simple three-element phased array.

The details of the invention and various embodiments can be better understood by further referring to the figures of the drawing. Referring to FIG. 1, a graphical representation of simulated intensity $E^2$ (see Eq. 1) and phase difference $|\gamma_P - \gamma_Q|$ (see Eq. 3) is shown for the simple three-element phased array described above with $a\omega/c=4$. The three dipole antennae are at positions whose cylindrical polar coordinates (r, $\phi$, z) have the values (0, 0, 0), $$\left(a, +\frac{\pi}{2}, 0\right) \text{ and } \left(a, -\frac{\pi}{2}, 0\right).$$

FIG. 2 illustrates animation of a superluminal polarization current. FIG. 2(*a*) illustrates a simplified dielectric solid containing negative (⊖) 202 and positive (⊕) 204 ions in an undisplaced linear arrangement. In FIG. 2(*b*), a spatially-varying electric field has been applied, causing the positive 204 and negative 202 ions to be displaced in opposite directions; a finite polarization P has therefore been induced. If the spatially-varying field is made to move along the direction of the arrow 206, the polarized region 208 moves with it. FIG. 2(*c*) is an illustration of a schematic side view of a practical superluminal emitter, showing metal electrodes 210 above a strip of dielectric 205 (shaded region) and a ground plate 212 below it. "0" indicates that there is no voltage on that electrode; the symbol +indicates that a voltage has been applied to that upper electrode. The voltage on the electrodes produces a finite polarization 214 of dielectric (darker shading). FIG. 2(*d*) illustrates that by switching the voltages on the electrodes on and off, the polarized region 214 (darker shading) can be made to move along the dielectric 205. FIG. 2(*e*) is an illustration of the top view, showing the curvature of the dielectric 205 (lighter shaded region). The curvature introduces centripetal acceleration in the moving polarized region. Note also that the electrodes 210 (black shaded regions) cover only part of the top surface of the dielectric. This section of the source (electrodes, dielectric and groundplate) can be referred to as "the array", for convenience. FIG. 2(*f*) is an illustration of the completed apparatus or array showing 41 amplifiers 217 that provide the voltages for the 41 electrodes 210 (partly visible) on top of the alumina dielectric 205. The end of the groundplate 212 can be seen beneath the dielectric. FIG. 2(*g*) illustrates the turntable or rotation means 220 used to rotate the array; the dielectric 205 and the amplifiers 217 are also visible.

FIG. 3 is an illustration of the coordinates used to measure the spatial distribution of radiation from the array. Various experiments were conducted to test the invention in which the orientation of the array with respect to the detector were as illustrated in FIGS. 3(*a*)-3(*b*). For FIGS. 3(*a*) and 3(*b*), the detector P is at a fixed point, distance R from the array; the array is placed on a platform tilting about a horizontal axis pivot that is in turn fixed to a turntable rotating about a vertical axis. In FIG. 3(*a*), the array plane is vertical; its long axis is tilted to an angle $\Phi_V$ with respect to horizontal; the turntable is rotated about a vertical axis so that the array plane makes an angle $\theta_V$ (in the horizontal plane) with the line connecting P and the array center. In FIG. 3(*b*), the array plane is initially horizontal; the array plane is then tilted to an angle $\theta_H$ with respect to horizontal. The turntable is rotated about the vertical axis so that the projection of the long axis of the array on the horizontal plane makes an angle $\Phi_H$ with the line connecting P and the array center. (Here, it is assumed that the detector and array center are at the same height from the ground.) Note that the coordinate systems are not equivalent. For example, $\tan\Phi_V = \tan\Phi_H/\cos\theta_H$ and $\tan\theta_V/\sin\Phi_V = \tan\theta_H/\sin\Phi_H$. Referring to FIG. 3(*c*), the model system is based around volume elements moving on circular paths around an origin at O; a typical path is shown, with the array being represented by thicker shading. The array center is at (a,0,0), and the tangent to the array is parallel to the y axis; the distances to the detector from O ($R_P$) and from the array center (R) are compared. FIG. 3(*d*) defines the spherical polar coordinates $R_P$, $\theta_P$, $\phi_P$ used above. The arrow indicates the direction of propagation of the polarization current distributions in the array.

FIGS. 4(*a*) and (*b*) are graphical illustrations of the phase difference $\gamma_P - \gamma_Q$ (vertical axis) for a source speed $\upsilon/c=1.25$ as a function of source to detector distance R and the polar angle $\theta_V$ [FIG. 4(*a*)], and as a function of R and the azimuthal angle $\Phi_V$ [FIG. 4(*b*)]. P and Q are positioned such that $R=R^{(P)}=R^{(Q)}$, with a tangential separation $R|\theta_V^{(P)}-\theta_V^{(Q)}|$ of 12 m between P and Q; the orientation of the array is described by the experimental coordinates $\theta_V$ and $\Phi_V$ (see FIG. 3 and the rear horizontal axes of the figures). In the upper figure $\Phi_V=0$ and in the lower figure $\theta_V=60°$.

FIGS. 5(*a*), (*b*), and (*c*) are graphical illustrations of the phase difference $\gamma_P - \gamma_Q$ (vertical axis) for a source speed $\upsilon/c=1.25$ as a function of (R, $\theta_V$), including the effect of reflections from the ground. As before, P and Q are positioned such that $R=R^{(P)}=R^{(Q)}$, with a tangential separation of 12 m between P and Q; the orientation of the array is described by the experimental coordinates $\theta_V$ and $\Phi_V$ (see FIG. 3 and rear horizontal axes of the figures). Results are shown for $\Phi_V=0$ [FIG. 5(*a*)], −10° [FIG. 5(*b*)] and 10° [FIG. 5(*c*)].

FIGS. 6(*a*) and 6(*b*) are graphical illustrations of the phase difference $\gamma_P - \gamma_Q$ (vertical axis) for a source speed $\upsilon/c=1.25$ as a function of (R, $\Phi_V$), including the effect of reflections from the ground. As before, P and Q are positioned such that $R=R^{(P)}=R^{(Q)}$, with a tangential separation of 12 m between P and Q; the orientation of the array is described by the experimental coordinates $\theta_V$ and $\Phi_V$ (see FIG. 3 and rear horizontal axes of the figures). The figures show results for $\theta_V=30°$ [FIG. 6(*a*)] and 60° [FIG. 6(*b*)].

FIGS. 7(*a*) and 7(*b*) are illustrations of the theoretical intensity (a) and phase (b) for a source speed of $\upsilon/c=1.25$, an array to detector distance of $R=R^{(P)}=R^{(Q)}=980$ m and a tangential P-Q antenna separation of $R|\theta_V^{(P)}-\theta_V^{(Q)}|=12$ m plotted as a function of $\theta_V$ for several values of $\Phi_V$ (see inset key). The points are experimental data; the solid curves are the theoretical predictions of the model. Note that the model reproduces all aspects of the data quantitatively.

FIGS. 8(*a*) and 8(*b*) are illustrations of experimental and theoretical intensity [FIG. 8(*a*)] and phase [FIG. 8(*b*)] for a source speed of $\upsilon/c=1.063$, an array to detector distance of $R=R^{(P)}=R^{(Q)}=980$ m and a tangential P-Q antenna separation of $R|\theta_V^{(P)}-\theta_V^{(Q)}|=12$ m plotted as a function of $\theta_V$ for several values of $\Phi_V$ (see inset key). The points are experimental data and the curves are theoretical predictions of the model for the same parameters. Note that the change in source speed shifts both the position of the maximum intensity and that of the large phase excursions (cf. FIG. 7).

FIGS. 9(*a*)-9(*d*) are illustrations of intensity and phase data for a source speed of $\upsilon/c=1.063$, an array to detector distance of $R=R^{(P)}=R^{(Q)}=180$ m and a tangential P-Q antenna separation of 3 m plotted as a function of $\theta_V$ for several values of $\Phi_V$ (see inset key). FIGS. 9(*a-d*) are representative of intensity and phase data for a source speed of $\upsilon/c=1.063$ and an array to detector distance of $R=R^{(P)}=R^{(Q)}=404$ m plotted as a function of $\theta_V$ for tangential P-Q antenna separations of 3 m, 5.9 m and 12 m (see inset key); $\Phi_V=1°$ for all data sets.

FIGS. 10(*a*) and 10(*b*) are illustrations of intensity and phase for a full-circle array versus $\theta_V$. A source speed of $\upsilon/c=1.25$, an array to detector distance of $R=R^{(P)}=R^{(Q)}=979.6$ m and a tangential P-Q separation of $R|\theta_V^{(P)}-\theta_V^{(Q)}|=12$ m have been assumed; $\Phi_V=0$. The calculation ignores the effect of reflection from the ground; however, a comparison of FIGS. 4, 5 and 6 shows that this does not much affect the overall complexity of the phase fronts.

FIGS. 11(*a*) and 11(*b*) are illustrations of intensity [FIG. 11(*a*)] and phase [FIG. 11(*b*)] for a full-circle array versus $\theta_V$. A source speed of $\upsilon/c=1.063$, an array to detector distance of $R=R^{(P)}=R^{(Q)}=979.6$ m and a tangential P-Q separation of $R|\theta_V^{(P)}-\theta_V^{(Q)}|=12$ m have been assumed; $\Phi_V=0$. The calculation ignores the effect of reflection from the ground.

The various polarization current base array examples shown above illustrate a novel array capable of producing a complex phase front effective against various countermeasure systems. A user of the present invention may choose any of the above, or an equivalent thereof, depending upon the desired application. In this regard, it is recognized that various forms of the subject invention could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A radiation emitting source for sensing targets comprising:

a dipole antenna array (FIGS. 2(*c*), 2(*d*), 2(*e*), 2(*f*), 2(*g*) having elements excited at predetermined phases including a curved solid dielectric strip (205) having negative (202) and positive (204) ions and having electrodes (210) coupled above and a ground plate (212) coupled below and said dielectric strip (205) having a finite polarization region (214) created by selectively applying a spatially varying electric field by applying finite voltages (215) to a select group of electrodes where said voltages are produced by amplifiers (217) coupled to said electrodes (210);

said amplifiers (217) selectively varying, oscillating or switching on or off the voltages applied to the electrodes (210) to effect movement of the finite polarization region (214) along the curved solid dielectric strip (205) introducing centripetal acceleration in the finite polarization region and creating a traveling wave oscillating superluminal polarization current (FIG. 2(*b*)) source.

2. The radiation emitting source as recited in claim 1, where the curved solid dielectric strip is a solid strip of alumina, the electrodes are metal and the ground plate is continuous thereby effectually forming a series of capacitive elements.

3. The radiation emitting source as recited in claim 2, where the curved solid dielectric has the curvature of an approximately 10 degree circular arc and a thickness of approximately 10 mm.

4. The radiation emitting source as recited in claim 3, where the coupling of the electrodes above the dielectric is an attachment that only covers approximately 10 mm of the dielectric upper surface, whereby the polarization current has both a radial and vertical component.

5. The radiation emitting source as recited in claim 1, where individual shielded amplifiers are coupled between the electrodes and the electric field generator for driving each electrode.

6. The radiation emitting source as recited in claim 1, further comprising a rotation means adapted to rotate the antenna array about an orthogonal axis.

7. A superluminal polarization current source comprising:

an array (FIG. 2(*f*)) including a plurality of antenna element amplifiers (217) each coupled to one of a plurality of metal electrodes (210) each coupled above a dielectric strip (205) having a continuous ground plate (212) coupled below said dielectric strip forming a series of amplifier-driven capacitive elements (FIGS. 2(*c*)-2(*f*));

each of said plurality of antenna element amplifiers (217) being adapted to selectively switch on or switch off or oscillate or vary a voltage to each of said electrodes (210); and a rotation means (220) adapted to rotate the array about an axis orthogonal with respect to the plane of the capacitive elements.

8. The current source as recited in claim 7, where the dielectric is a curved and solid strip of alumina.

9. The current source as recited in claim 8, where the curved solid dielectric has the curvature of an approximately 10 degree circular arc and a thickness of approximately 10 mm.

10. The current source recited in claim 9, where the coupling of the electrodes above the dielectric is an attachment that only covers approximately 10 mm of the dielectric upper surface, whereby the polarization current has both a radial and vertical component.

11. A method for generating a complex phase front from a polarization current source comprising the steps of:

selectively switching on or switching off a voltage input with an oscillator circuit to each of a plurality of antenna element amplifiers in an array each coupled to one of a plurality of metal electrodes each coupled above a dielectric strip having a continuous ground plate coupled below said dielectric strip forming a series of amplified capacitive elements;

applying a spatially varying field to the dielectric strip polarizing the positive and negative ions forming a finite polarization region;

selectively switching on or switching off the voltage along the series of amplified capacitive elements causing the polarization region to propagate creating a superluminal polarization current;

rotating the array; and emitting radiation and generating a complex phase front.

12. The method of generating a complex phase front as recited in claim 11, further comprising the step of:

changing the speed of propagation of the polarization region by varying the switching selectivity to steer the radiation and phase front.

13. The method as recited in claim 11, further comprising the step of:

producing a polarization current having a radial and a vertical component by coupling each electrode to the dielectric covering only an inner part of the electrode approximately 10 mm wide.

14. The method as recited in claim 11, further comprising the step of:

providing a phase front whose source moves with centripetal acceleration by providing said dielectric strip that is solid and made of alumina with a curvature.

15. The method recited in claim 14, where the curved solid dielectric has the curvature of an approximately 10 degree circular arc and a thickness of approximately 10 mm.

16. The method as recited in claim 11, where rotating is orthogonal with respect to the plane of the elements.

17. The method as recited in claim 11, where the complex phase front has continuous variations of phase difference both as a function of polar and azimuthal angles and of source to detector distance.

18. The method as recited in claim 11, where the array is rotated about two axes.

19. The method as recited in claim 11, further comprising the step of:

providing a phase front whose source moves with centripetal acceleration by providing said dielectric strip that forms a circle and is solid and made of alumina.

20. The method as recited in claim 19, where the circle formed has a radius R.

* * * * *